US011347170B2

(12) United States Patent
Ubagai

(10) Patent No.: US 11,347,170 B2
(45) Date of Patent: May 31, 2022

(54) FUSING DEVICE AND IMAGE FORMING APPARATUS

(71) Applicant: Oki Electric Industry Co., Ltd., Tokyo (JP)

(72) Inventor: Akira Ubagai, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/177,358

(22) Filed: Feb. 17, 2021

(65) Prior Publication Data

US 2021/0263457 A1 Aug. 26, 2021

(30) Foreign Application Priority Data

Feb. 20, 2020 (JP) ..... JP2020-027239

(51) Int. Cl.
*G03G 15/20* (2006.01)

(52) U.S. Cl.
CPC ..... *G03G 15/2057* (2013.01); *G03G 15/2064* (2013.01); *G03G 2215/2025* (2013.01)

(58) Field of Classification Search
CPC ..... G03G 15/2017; G03G 15/2039; G03G 15/2042; G03G 15/2053; G03G 15/2057; G03G 2215/2003
See application file for complete search history.

(56) References Cited

U.S. PATENT DOCUMENTS

| | | | | |
|---|---|---|---|---|
| 2019/0235425 | A1* | 8/2019 | Sato | G03G 15/2053 |
| 2020/0004184 | A1* | 1/2020 | Takazawa | G03G 15/2057 |
| 2021/0165348 | A1* | 6/2021 | Shimada | G03G 15/2057 |
| 2021/0191301 | A1* | 6/2021 | Fujimoto | G03G 15/2057 |

FOREIGN PATENT DOCUMENTS

JP 2019-128507 A 8/2019

* cited by examiner

*Primary Examiner* — Thomas S Giampaolo, II
(74) *Attorney, Agent, or Firm* — Muncy, Geissler, Olds & Lowe, P.C.

(57) ABSTRACT

A fusing device includes an annular belt, a heat generation member arranged inside the annular belt, and a heat transmission member that has first and second faces, wherein the first face opposes the heat generation member and the second face opposes the annular belt, and the heat transmission member transmits heat to the annular belt, wherein the heat transmission member satisfies the following Conditional Expression (1):

$$D/L \geq 0.18 \times S - 28 \quad (1)$$

where

D means a thermal diffusivity [$\times 10^{-6}$ $m^2/s$] that is determined along the first face of the heat transmission member, L means a half of an interval [$\times 10^{-3}$ m] between two of the heat generation parts adjacent to one another, and S: the carrying speed [$\times 10^{-3}$ m/s] at which the medium is carried.

12 Claims, 11 Drawing Sheets

*Fig. 8*
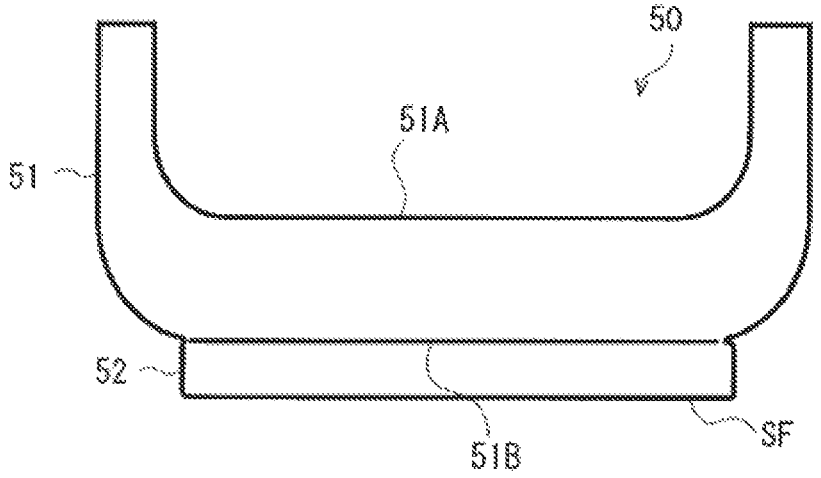
*Fig. 9*
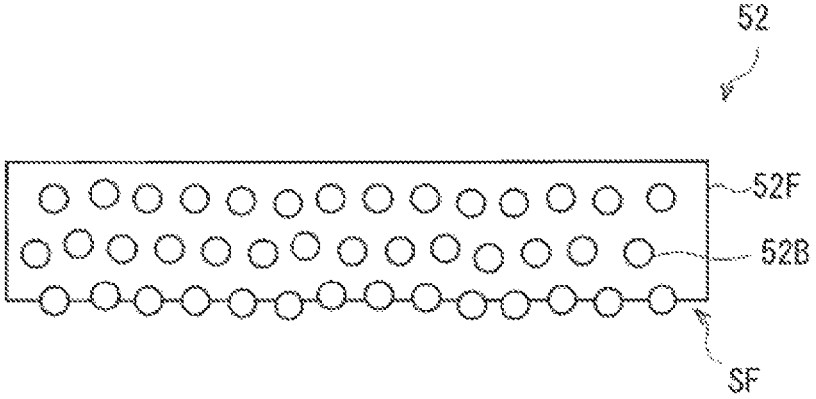
*Fig. 10*
| | Heat Resistant Temp. [°C] | Thermal Conductivity [W/mK] | Dynamic Friction Coefficient |
|---|---|---|---|
| PTFE | 290 | 0.23 | 0.1 |
| PAI | 260 | 0.38 | 0.2~0.3 |

FUSING DEVICE AND IMAGE FORMING APPARATUS

TECHNICAL FIELD

This invention relates to a fusing device and an image forming apparatus provided with it.

BACKGROUND

Among image forming apparatuses, there is one that fuses an image formed on a recording medium by a thermal fusing device. For example, disclosed in Patent Document 1 is a technology that heat generated by a heater is diffused on a fusing belt by a heat diffusion member in a fusing device.

RELATED ART

Patent Document(s)

[Patent Doc. 1] JP Laid-Open Patent Application Publication 2019-128507

SUBJECT(S) TO BE SOLVED

By the way, expected in a fusing device is that heat generated by a heater is transmitted to a fusing belt (annular belt or endless belt) as uniformly as possible so as to fuse an image formed on a recording medium well.

It is desired to offer a fusing device and an image forming apparatus that allow obtaining a fine fusing performance.

SUMMARY

A fusing device, disclosed in the application, includes an annular belt that opposes a medium carried at a prescribed carrying speed, a heat generation member that has multiple heat generation parts installed apart from one another, the heat generation member being arranged inside the annular belt, and a heat transmission member that has two surfaces, which are first and second faces, and is installed between the heat generation member and the annular belt, wherein the first face opposes the heat generation member and the second face opposes the annular belt, and the heat transmission member transmits heat that is generated in the heat generation member to the annular belt, wherein the heat transmission member satisfies the following Conditional Expression (1):

$$D/L \geq 0.18 \times S - 28 \quad (1)$$

where

D means a thermal diffusivity [$\times 10^{-6}$ $m^2/s$] that is determined along the first face of the heat transmission member, L means a half of an interval [$\times 10^{-3}$ m] between two of the heat generation parts adjacent to one another, and S: the carrying speed [$\times 10^{-3}$ m/s] at which the medium is carried.

An image forming apparatus, disclosed in the application, includes the fusing device discussed above.

According to the fusing device and the image forming apparatus in an embodiment of this invention, because Conditional Expression (1) is satisfied, variation in temperature of the annular belt can be reduced. Thereby a fine fusing performance can be obtained. Note that the effects of this invention are not limited to this but can be any of the effects described below.

BRIEF DESCRIPTIONS OF THE DRAWINGS

FIG. 8 is a schematic cross-sectional view for explaining the outline of a heat transmission member shown in FIG. 5.

FIG. 9 is a schematic diagram magnifying an opposing member (a slid member) shown in FIG. 8.

FIG. 10 is an explanatory table listing characteristic values of the component materials of the opposing member (slid member) shown in FIG. 9.

DETAILED DESCRIPTION OF THE PREFERRED EMBODIMENT(S)

Figure 1:
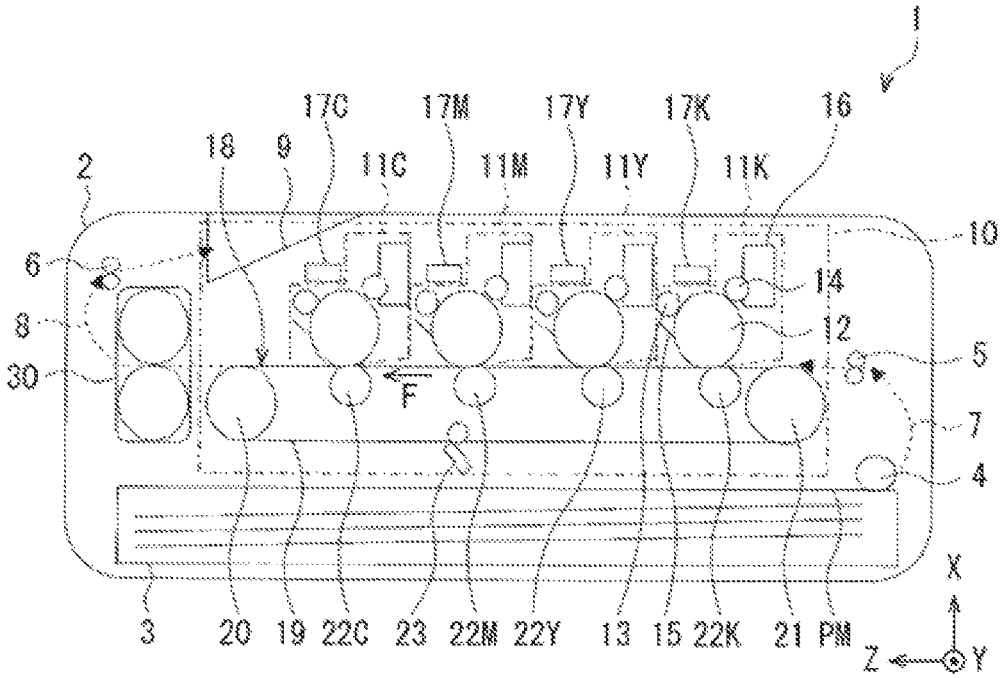
FIG. 1 is a schematic diagram showing a whole configuration example of an image forming apparatus of an embodiment.

Below, an embodiment(s) of this invention is explained in detail referring to drawings. Note that the following explanations are on a specific example of this invention and that this invention is not limited to the following mode. Also, this invention is not limited to the dispositions, dimensions, or dimension ratios of individual components shown in the drawings. The explanations are given in the following order.

1. Embodiment
2. Experimental examples
3. Modification examples

1. EMBODIMENT

[Outline Configuration of Image Forming Apparatus 1]

FIG. 1 is a schematic diagram showing a whole configuration example of an image forming apparatus 1 provided with a fusing device of an embodiment of this invention. The image forming apparatus 1 is, for example, a printer utilizing an electrophotographic system, configured so as to form a monochromatic or color image on a recording medium PM such as paper by performing an image forming operation using a developer such as toner. Note that, in this specification, a position closer to a sheet feeding tray 3 viewed from an arbitrary position on a carrying route where the recording medium PM is carried, or a direction toward the sheet feeding tray 3 is denoted as upstream. Furthermore, a position closer to a stacker 9 where the recording medium PM is ejected and stacked viewed from an arbitrary position on the carrying route, or a direction toward the stacker 9 is denoted as downstream. The direction from the upstream to the downstream is denoted as a carrying direction F.

The image forming apparatus 1 is provided with the sheet feeding tray 3, a hopping roller 4, a registration roller pair 5, an image forming part 10, a fusing device 30, and an ejection roller pair 6 for example inside a main body frame 2 that is the chassis of the apparatus main body for example.

The sheet feeding tray 3 is an accommodation part that accommodates the recording medium PM. On the sheet feeding tray 3, multiple pieces of the recording medium PM are stacked. Installed in the downstream of the sheet feeding tray 3 is the hopping roller 4.

The hopping roller 4 is a rotation member that is pressed against the surface of the recording medium PM and feeds the recording medium PM downstream along a guide 7 that is part of the carrying route. The hopping roller 4 is rotated by power transmitted from a hopping motor (not shown) centering on the central shaft of the hopping roller 4 as its rotational axis. Installed in the downstream of the hopping roller 4 is the registration roller pair 5.

The registration roller pair 5 is configured so as to carry the recording medium PM toward the image forming part 10. The registration roller pair 5 corrects skew of the recording medium PM by having the tip portion of the recording medium PM abut against it in carrying the recording medium PM. Installed in the downstream of the registration roller pair 5 is the image forming part 10.

(Image Forming Part 10)

The image forming part 10 is a mechanism that forms an image (a toner image) and transfers the image to the recording medium PM. The image forming part 10 has four development units 11 (development units 11K, 11Y, 11M, and 11C), four exposure units 17 (exposure units 17K, 17Y, 17M, and 17C), and a transfer belt unit 18.

The four development units 11 (development units 11K, 11Y, 11M, and 11C) are mechanisms that form images using toners that are developers based on print data sent from a higher-level device such as a personal computer. The four development units 11 are configured detachably from the image forming apparatus 1. Specifically, the development unit 11K forms a black image, the development unit 11Y forms a yellow image, the development unit 11M forms a magenta image, and the development unit 11C forms a cyan image. In this example, the development units 11K, 11Y, 11M, and 11C are disposed in this order in the carrying direction F of the recording medium PM. The development units 11K, 11Y, 11M, and 11C have the configuration except for using different color toners in forming images as mentioned above. As shown in FIG. 1, each of the development units 11 has a photosensitive drum 12, a charging roller 13, a development roller 14, a cleaning blade 15, and a toner accommodation part 16 for example.

The photosensitive drum 12 is a columnar member that carries an electrostatic latent image on its surface (surface layer part) and is configured using a photosensitive body (an organic-system photoreceptor for example). The photosensitive drum 12 rotates clockwise in this example by power transmitted from a photosensitive body motor (not shown). The photosensitive drum 12 is charged by the charging roller 13 and exposed by the corresponding exposure unit 17. Thereby, an electrostatic latent image is formed on the surface of the photosensitive drum 12. Then, by the development roller 14 supplying a toner, an image corresponding to the electrostatic latent image is formed (developed) on the photosensitive drum 12.

The charging roller 13 is configured so as to charge the surface (surface layer part) of the photosensitive drum 12. The charging roller 13 is disposed so as to contact the surface (circumferential face) of the photosensitive drum 12 and also be pressed against the photosensitive drum 12 with a prescribed pressing amount. The charging roller 13 rotates anticlockwise in this example according to the rotation of the photosensitive drum 12. Applied to the charging roller 13 is a prescribed charging voltage.

The development roller 14 is configured so as to carry a charged toner on its surface. The development roller 14 is disposed so as to contact the surface (circumferential face) of the photosensitive drum 12 and also be pressed against the photosensitive drum 12 with a prescribed pressing amount. The development roller 14 rotates anticlockwise in this example by power transmitted from the photosensitive body motor (not shown). Applied to the development roller 14 is a prescribed development voltage.

The cleaning blade 15 is a member that scrapes off a toner remaining on the surface of the photosensitive drum 12 for cleaning. The cleaning blade 15 is disposed so as to counter-contact the surface of the photosensitive drum 12 and also be pressed against the photosensitive drum 12 with a prescribed pressing amount.

The toner accommodation part 16 is configured so as to accommodate a toner. Specifically, for example, the toner accommodation part 16 of the development unit 11K accommodates black toner, the toner accommodation part 16 of the development unit 11Y accommodates yellow toner, the toner accommodation part 16 of the development unit 11M accommodates magenta toner, and the toner accommodation part 16 of the development unit 11C accommodates cyan toner.

The four exposure units 17 (exposure units 17K, 17Y, 17M, and 17C) are mechanisms that radiate light onto the photosensitive drums 12 of the four development units 11, and are configured using LED (Light Emitting Diode) heads for example. Specifically, the exposure unit 17K radiates light onto the photosensitive drum 12 of the development unit 11K, the exposure unit 17Y radiates light onto the photosensitive drum 12 of the development unit 11Y, the exposure unit 17M radiates light onto the photosensitive drum 12 of the development unit 11M, and the exposure unit 17C radiates light onto the photosensitive drum 12 of the development unit 11C. Thereby, electrostatic latent images are formed on the surfaces of these photosensitive drums 12. Then, images corresponding to the electrostatic latent images are formed on the photosensitive drums 12.

The transfer belt unit 18 is a mechanism that transfers images formed on the surfaces of the photosensitive drums 12 by Coulomb force to the surface of the recording medium PM and also carries the recording medium PM in the carrying direction F. The transfer belt unit 18 carries the recording medium PM to which the images were transferred toward the fusing device 30. The transfer belt unit 18 has a transfer belt 19, a drive roller 20, a driven roller 21, four transfer rollers 22 (transfer rollers 22K, 22Y, 22M, and 22C), and a cleaning blade 23. The transfer belt 19 is an annular belt formed seamlessly that can carry the recording medium PM. The transfer belt 19 is stretched by the drive roller 20 and the driven roller 21. The drive roller 20 is a rotation member that rotates so as to carry the recording medium PM toward the fusing device 30 by power transmitted from a belt motor (not shown) and circularly rotates the transfer belt 19. The driven roller 21 is a member that adjusts a tensile force applied to the transfer belt 19 while stretching the transfer belt 19 together with the drive roller 20. The four transfer rollers 22 are rotation members that transfer the images formed on the surfaces of the photosensitive drums 12 of the corresponding development units 11 onto the transfer target surface of the recording medium PM. The transfer roller 22K is disposed opposing the photosensitive drum 12 of the development unit 11K through the transfer belt 19, the transfer roller 22Y is disposed opposing the photosensitive drum 12 of the development unit 11Y through the transfer belt 19, the transfer roller 22M is disposed opposing the photosensitive drum 12 of the development unit 11M through the transfer belt 19, and the transfer roller 22C is disposed opposing the photosensitive drum 12 of the development unit 11C through the transfer belt 19. Applied to each of the transfer rollers 22K, 22Y, 22M, and 22C is a prescribed transfer voltage, thereby the images formed on the photosensitive drums 12 by the development units 11 are transferred onto the transfer target surface of the recording medium PM in the image forming apparatus 1. The cleaning blade 23 is a member that scrapes off waste toners remaining on the surface of the transfer belt 19 for cleaning. Installed in the downstream of the image forming part 10 is the fusing device 30.

(Fusing Device 30)

The fusing device 30 is a mechanism that applies heat and pressure to an image transferred onto the recording medium PM carried from the transfer belt unit 18, thereby fusing the image onto the recording medium PM. In the image forming apparatus 1, as well as fusing the image to the recording medium PM, the fusing device 30 carries the recording medium PM toward the ejection roller pair 6 along the guide 8 that is part of the carrying route. Installed in the downstream of the fusing device 30 is the ejection roller pair 6.

The ejection roller pair 6 is configured so as to carry the recording medium PM toward the stacker 9. This configuration allows the image forming apparatus 1 to eject the recording medium PM to the stacker 9. The stacker 9 is a member that is installed outside the main body frame 2 and stacks the recording medium PM to which an image is fused.

[Detailed Configuration of Fusing Device 30]

Figure 2:
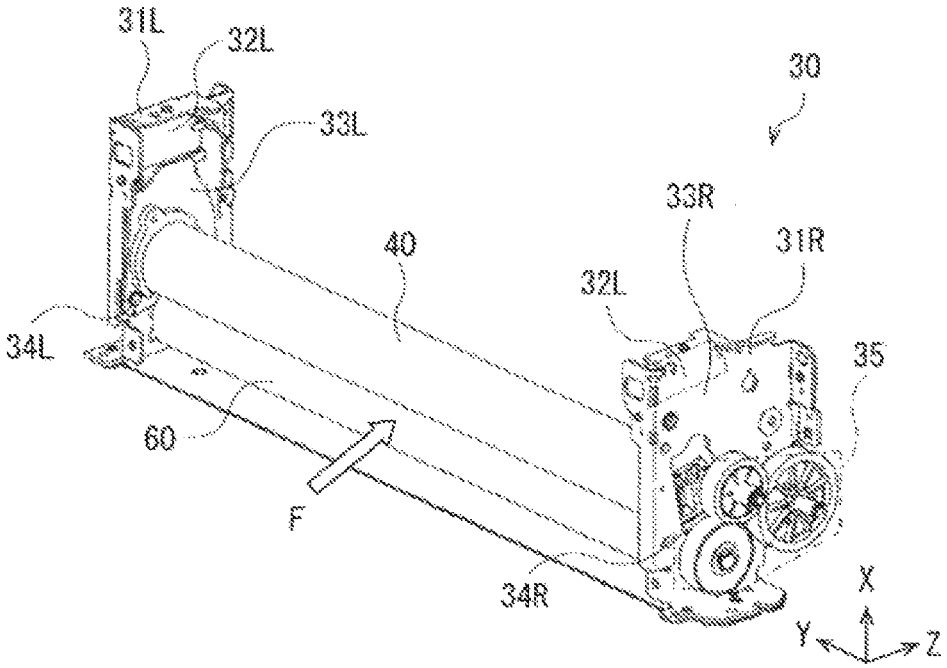
FIG. 2 is a perspective view showing a configuration example of the main part of a fusing device shown in FIG. 1.
Figure 3:
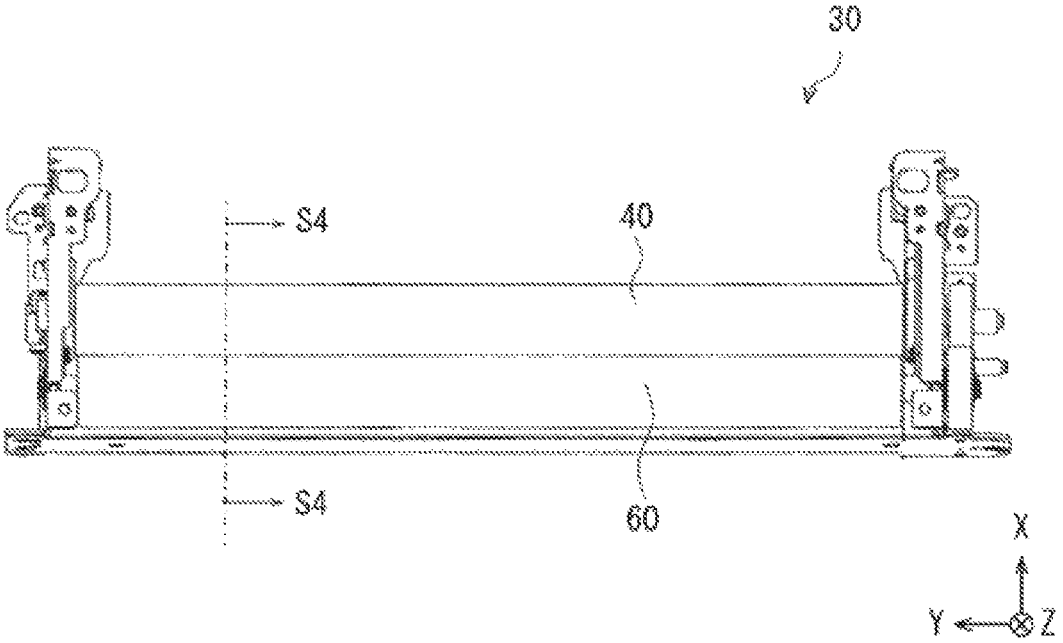
FIG. 3 is a front view showing a configuration example of the main part of the fusing device shown in FIG. 1.
Figure 4:
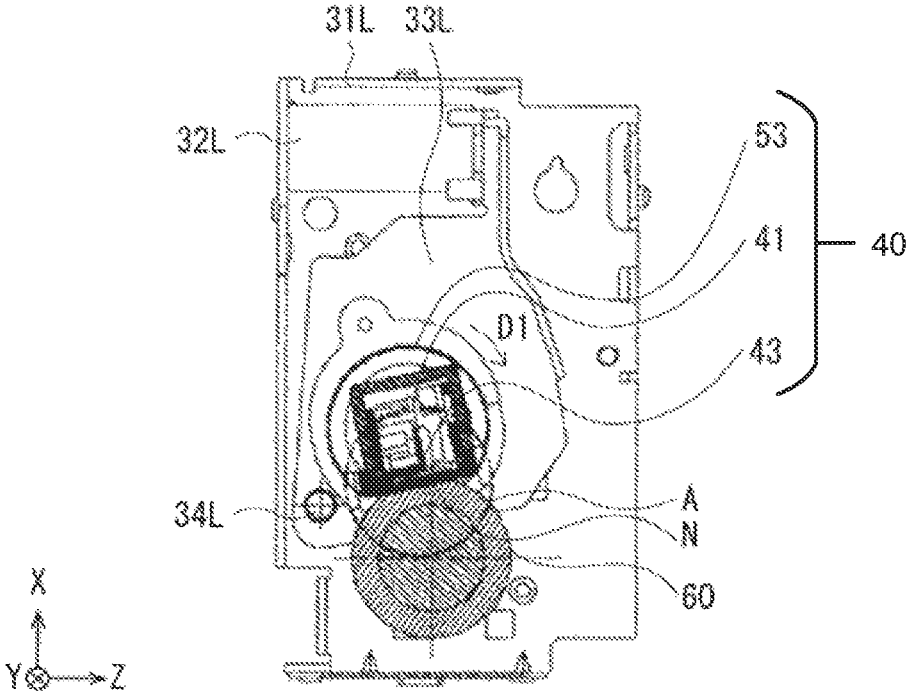
FIG. 4 is a cross-sectional view showing a configuration example of the main part of the fusing device shown in FIG. 3.
Figure 5:
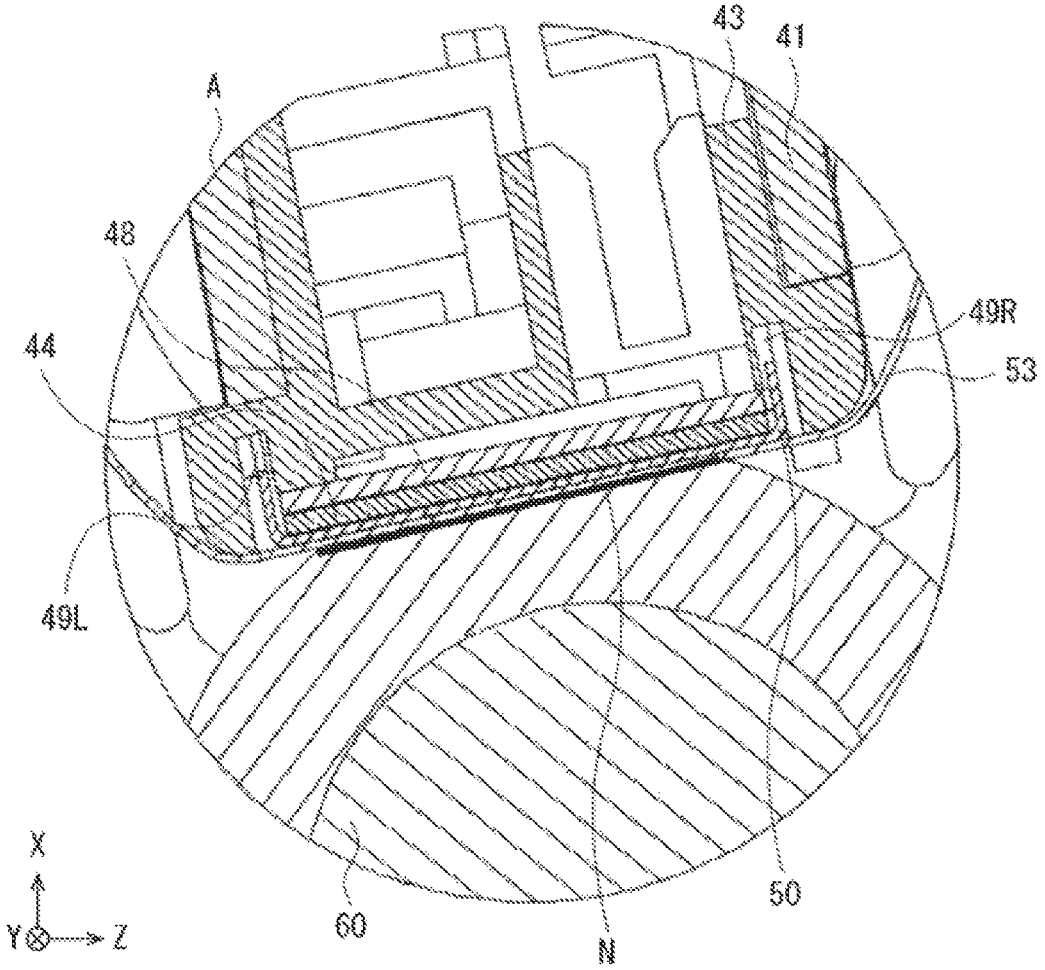
FIG. 5 is an expanded cross-sectional view magnifying part of a configuration example of the main part of the fusing device shown in FIG. 4.
Figure 6:
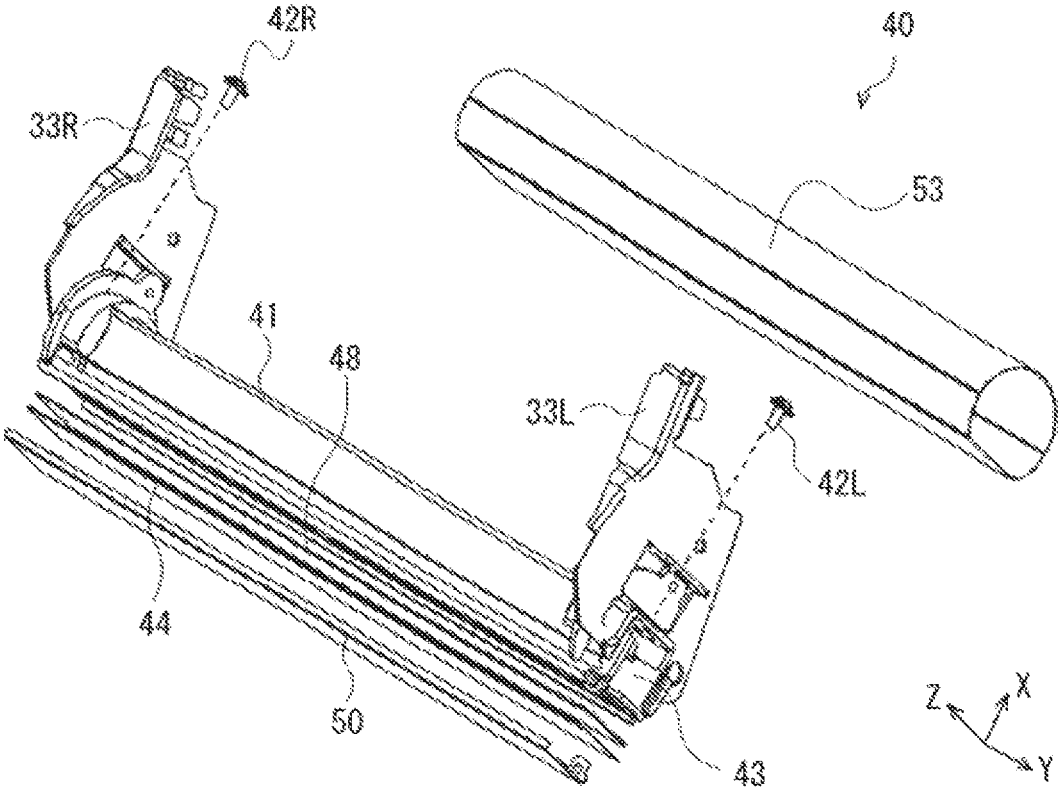
FIG. 6 is an exploded perspective view showing an annular belt unit shown in FIG. 2.

Below, the detailed configuration of the fusing device 30 is explained referring to FIGS. 2-6. FIG. 2 is a perspective view showing the main components of the fusing device 30. FIG. 3 is a front view showing the main components of the fusing device 30 viewed from the Z-axis direction. FIG. 4 is a cross-sectional view showing the main components of the fusing device 30 along S4-S4 shown in FIG. 3. FIG. 5 is an expanded cross-sectional view magnifying a region A shown in FIG. 4. FIG. 6 is an exploded perspective view showing an annular belt unit 40 (mentioned below). FIG. 6 further shows levers 33L and 33R (mentioned below) in addition to the annular belt unit 40.

As shown in FIG. 2, the fusing device 30 has side frames 31L and 31R, springs 32L and 32R, levers 33L and 33R, drive gears 35, the annular belt unit 40, and a pressure application roller 60.

The side frames 31L and 31R are members fixed to the main body frame 2 of the image forming apparatus 1 using screws for example. As shown in FIGS. 2 and 4, the spring 32L is an elastic member such as a spring configured so as to apply a bias force to the lever 33L. One end of the spring 32L is fixed to the side frame 31L, and the other end of the spring 32L is fixed to the lever 33L. In the same manner as the spring 32L, the spring 32R is an elastic member such as a spring configured so as to apply a bias force to the lever 33R. The lever 33L is configured so as to rotate in a direction D1 centering on a rotational fulcrum 34L in the XZ plane by the bias force applied from the spring 32L. The lever 33L is attached to the side frame 31L. In the same manner as the lever 33L, the lever 33R is configured so as to rotate in the direction D1 centering on a rotation fulcrum 34R in the XZ plane by the bias force applied from the spring 32R. When the fusing device 30 is not performing a fusing operation, the levers 33L and 33R are pushed to prescribed positions by lever fixing members (not shown). That is, because the spring 32L is pushed by the lever fixing member through the lever 33L, it can apply the bias force to the lever 33L when the lever 33L is released from the lever fixing member. The same applies to the spring 32R. The drive gears 35 are configured so as to transmit power from an annular belt motor (not shown) to the pressure application roller 60.

By this configuration, when the fusing device 30 performs a fusing operation, the drive gears 35 transmit power from the annular belt motor to the pressure application roller 60. Also, by the levers 33L and 33R being released from the lever fixing members according to the operation of the drive gears 35, the levers 33L and 33R rotate in the direction D1 centering on the rotation fulcrums 34L and 34R. Therefore, by the annular belt unit 40 attached to the levers 33L and 33R being pressed onto the pressure application roller 60, a nip part N is formed on the annular belt unit 40 and the pressure application roller 60. FIG. 4 shows a state where the nip part N is formed on the annular belt unit 40 and the pressure application roller 60. By the recording medium PM being carried downstream while being nip-held by an annular belt 53 and the pressure application roller 60, that is, by the recording medium PM passing through the nip part N, heat and pressure are applied to an image transferred onto the recording medium PM, thereby the image is fused onto the recording medium PM.

(Annular Belt Unit 40)

The annular belt unit 40 is configured so as to apply heat to an image on the recording medium PM. As shown in FIGS. 4~6, the annular belt unit 40 has a stay 41, a holding member 43, a heater 44, a heat reserving plate 48, a heat transmission member 50, and the annular belt 53. The stay 41 is a member that supports the annular belt 53. The stay 41 is fixed to the lever 33L with a screw 42L and also fixed to the lever 33R with a screw 42R. The holding member 43 is a member that holds the heater 44, the heat reserving plate 48, and the heat transmission member 50. The holding member 43 is fixed to the stay 41. As shown in FIGS. 5 and 6, the heat reserving plate 48, the heater 44, the heat transmission member 50, and the annular belt 53 are disposed in this order in approximately the X-axis direction. That is, the heat reserving plate 48 opposes the heater 44, the heater 44 opposes the heat transmission member 50, and the heat transmission member 50 opposes the annular belt 53.

Figure 7:
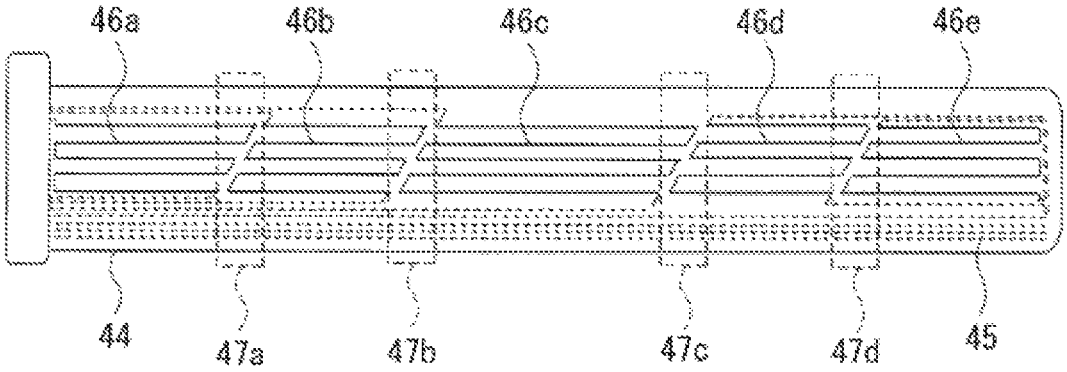
FIG. 7 is an explanatory diagram for explaining the outline of a heater shown in FIG. 5.

FIG. 7 is an explanatory diagram for explaining the outline of the heater 44. The heater 44 is a plate-shaped member extending in the Y-axis direction and a heat source to heat the annular belt 53. The heater 44 has electric wires 45, heat generation parts 46*a*~46*e*, and seams 47*a*~47*d*. The electric wires 45 are configured so as to let a current supplied from an external power source flow to each of the heat generation parts 46*a*~46*e*. The electric wires 45 comprise copper (Cu) for example. The heat generation parts 46*a*~46*e* are arranged along the width direction (Y-axis direction) intersecting perpendicularly with the rotation direction of the annular belt 53. In the annular belt unit 40, the heat generation parts 46*a*~46*e* can be selectively powered to generate heat according to the width of the recording medium PM for example.

Each of the heat generation parts 46*a*~46*e* comprises a resistance heat generating body. The resistance heat generating body comprises nickel-chromium (NiCr) alloy or silver palladium (AgPd) alloy for example. For example, when an image is formed on a wide recording medium PM such as an A3 sheet, the heater 44 lets the heat generation parts 46*a*~46*e* generate heat. Also, for example, when an image is formed on a narrow recording medium PM such as a postcard, it lets the heat generation part 46*c* generate heat. Thereby, the heater 44 suppresses energy consumption. Here, the direction intersecting perpendicularly with a plane consisting of the long direction (Y-axis direction) of the heater 44 and the short direction (approximate Z-axis direction) intersecting perpendicularly with the long direction of the heater 44 is hereafter denoted as a thickness direction (approximate X-axis direction).

In the heater 44, the seams 47*a*~47*d* are the boundary region between the heat generation part 46*a* pattern and the heat generation part 46*b* pattern, the boundary region between the heating generation part 46*b* pattern and the heat generation part 46*c* pattern, the boundary region between the heat generation part 46*c* pattern and the heat generation part 46*d* pattern, and the boundary region between the heat generation part 46*d* pattern and the heat generation part 46*e* pattern. That is, when the heater 44 generates heat, in the seams 47*a*~47*d*, temperature distribution in the long direction (Y-axis direction) of the heater 44 is not uniform. Note that although in this example the heater 44 has the heat generation parts 46*a*~46*e*, this invention is not limited to this but only needs to have at least one heat generation part for example. Also, although the heater 44 has the seams 47*a*~47*d*, this invention is not limited to this but instead can be configured of one heat generation part so as to have no seam for example.

The heat reserving plate 48 is a member that accumulates heat generated by the heater 44. In this example, the heat reserving plate 48 is a plate-shaped member extending in the Y-axis direction along the heater 44. The heat reserving plate 48 is arranged so as to make it hard to transmit heat generated by the heater 44 to the side opposite to the face of the heat reserving plate 48 opposing the heater 44.

Applied between the heater 44 and the heat reserving plate 48 is a heat conducting grease for efficiently transmitting heat generated by the heater 44. In the same manner, applied between the heater 44 and the heat transmission member 50 is a heat conducting grease. The heater 44 and the heat reserving plate 48 are disposed so as to be nipped between the holding member 43 and the heat transmission member 50 and are fixed by the holding member 43. Note that although in this example the heat conducting grease is applied between the heater 44 and the heat reserving plate 48, this invention is not limited to this, but no heat conducting grease needs to be applied. Also, although the heat conducting grease is applied between the heater 44 and the heat transmission member 50, this invention is not limited to this, but no heat conducting grease needs to be applied.

The heat transmission member 50 is a member having an approximate plate shape extending in the Y-axis direction along the heater 44 and is configured so as to transmit heat generated by the heater 44 to the annular belt 53. The heat transmission member 50 has a shape where both ends of the heat transmission member 50 are bent in the width direction viewed from the XZ plane. That is, the heat transmission member 50 has a recessed part opposing the heater 44 in the XZ cross section. As shown in FIG. 5, protrusion parts of the heat transmission member 50 in the XZ cross section are inserted to holding grooves 49L and 49R installed on the holding member 43. Because the holding grooves 49L and 49R are larger spaces than the protrusion parts of the heat transmission member 50, the heat transmission member 50 inserted to the holding grooves 49L and 49R can move in the thickness direction (approximate X-axis direction) by the annular belt unit 40 being pressed to the pressure application roller 60. That is, when the fusing device 30 performs a fusing operation, the heat transmission member 50 is pressed to the heater 44. At this time, the heat transmission member 50 transmits heat generated by the heater 44 to the annular belt 53.

Figure 11:
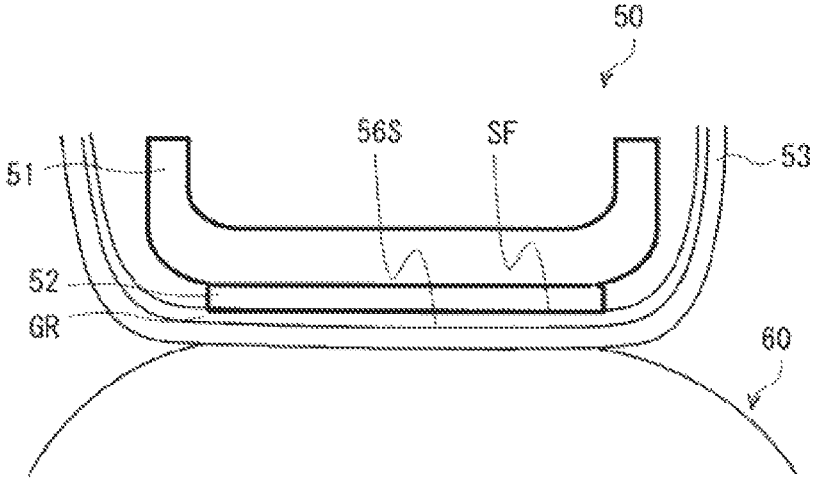
FIG. 11 is a schematic diagram magnifying a heat diffusion member and its vicinity shown in FIG. 8.

FIG. 8 is a schematic cross-sectional view for explaining the outline of the heat transmission member 50. FIG. 9 is a schematic diagram magnifying an opposing member (a slid member) 52 of the heat transmission member 50. FIG. 10 is an explanatory table listing characteristic values of preferable component materials of the opposing member 52. Furthermore, FIG. 11 is a schematic diagram magnifying the vicinity of the heat transmission member 50. As shown in FIG. 8, the heat transmission member 50 has a heat diffusion member 51 having a first face 51A opposing the heater 44 and a second face 51B on the opposite side of the first face 51A, and the opposing member 52. That is, formed on the heat diffusion member 51 is the opposing member 52 installed on the second face 51B of the heat diffusion member 51. The opposing member 52 has an opposing face SF opposing an inner circumferential face 56S (FIG. 11) of the annular belt 53. In this specification, meant by the opposing face SF "opposing" the inner circumferential face 56S of the annular belt 53 is that the opposing face SF has a dispositional relationship facing the inner circumferential face 56S. In this case, "opposing" also means that the opposing face SF contacts and comes into a dispositional relationship facing the inner circumferential face 56S or that the opposing face SF comes into a dispositional relationship facing the inner circumferential face 56S through another member such as a sliding grease GR mentioned below. The heater 44 is positioned on the opposite side of the opposing face SF of the heat diffusion member 51.

The heat diffusion member 51 comprises a metal having large thermal diffusivity indicating the heat transfer rate for example. The thickness Ta of the heat diffusion member 51 is 0.485 mm for example. The in-plane thermal diffusivity Da along the first face 51A of the heat diffusion member 51 is 60.4 $mm^2/s$ for example. In this example, the main ingredient of the heat diffusion member 51 is aluminum (Al). Here, the main ingredient means the ingredient occupying 50 weight % of the whole heat diffusion member 51. That is, the Al content is greater than those of any other materials in the heat diffusion member 51. Note that although in this example the heat diffusion member 51 contains Al, the heat diffusion member 51 is not limited this but can contain another metal having large thermal diffusivity. The heat diffusion member 51 can contain stainless steel (SUS), copper, or zinc (Zn) for example. Note that the thickness Ta of the heat diffusion member 51 is not limited to the thickness shown in this example.

The opposing member 52 comprises a resin having good slidability with the inner circumferential face 56S of the annular belt 53 for example. The thickness Tb of the opposing member 52 should preferably be 0.005 mm or greater and 0.015 mm or smaller, and is 0.015 mm for example. The in-plane thermal diffusivity Db along the opposing face SF of the opposing member 52 is 1.53 $mm^2/s$ for example. As shown in FIG. 9, the opposing member 52 contains a binder resin 52B as its main ingredient. The binder resin 52B constituting the opposing member 52 is polyamide-imide (PAI) having high toughness for example. Here, the main ingredient means an ingredient occupying 50 weight % of the whole opposing member 52. That is, the PAI content is greater than those of any other materials in the opposing member 52. Furthermore, the opposing member 52 contains multiple particulate fillers (hereafter called filler particles 52F) such as polytetrafluoroethylene (PTFE). FIG. 10 lists examples of heat resistant temperature [° C.], thermal conductivity [W/mK], and dynamic friction coefficient of PAI and PTFE. As listed in FIG. 10, the dynamic friction coefficient of PTFE constituting the filler particles 52F is smaller than the dynamic friction coefficient of PAI constituting the binder resin 52B. As shown in FIG. 9, the multiple filler particles 52F are distributed discretely for example inside the binder resin 52B. Part of the filler particles 52F contain portions exposed to the opposing face SF. Therefore, a fine concave-convex structure is formed on the opposing face SF. Also, even if the opposing face SF is worn by the opposing face SF sliding with the inner circumferential face 56S, because the multiple filler particles 52F are buried in the binder resin 52B, the opposing face SF can maintain the fine concave-convex structure. Here, the average particle diameter of the multiple filler particles 52F should preferably be 1 μm or greater and 30 μm or smaller. The reason is that by the average particle diameter of the multiple filler particles 52F being within the above-mentioned range, it becomes easier to control the surface roughness of the fine concave-convex structure on the opposing face SF to be appropriate. The arithmetic mean roughness Ra of the opposing face SF should preferably be 0.27 μm or greater and 1.8 μm or smaller. By the opposing face SF having such arithmetic mean roughness Ra, slidability of the inner circumferential face 56S with the opposing face SF can be kept appropriate, and the sliding grease GR (FIG. 11) mentioned below can be retained appropriately on the opposing face SF. Note that the arithmetic mean roughness Ra is specified by JIS B0601:2013. Also, the arithmetic mean roughness Ra of the opposing face SF can be controlled by changing the average particle diameter of the filler particles 52F for example. That is, the arithmetic mean roughness Ra of the opposing face SF can be increased by increasing the average particle diameter of the filler particles 52F, and the arithmetic mean roughness Ra of the opposing face SF can be decreased by decreasing the average particle diameter of the filler particles 52F. Furthermore, the arithmetic mean roughness Ra of the opposing face SF can be fine-tuned by changing the amount of the filler particles 52F added to the binder resin 52B. For example, if the binder resin 52B is PAI and the filler particles 52F are PTFE, the weight ratio of PAI:PTFE should preferably be within a range of 1:0.5 to 1:2 for example.

With respect to the filler particles 52F, when the filler particles 52F are larger than a thickness of a sliding layer, the filler particles 52F are exposed from a sliding layer surface. It is preferred that the filler particles 52F are smaller than the thickness of the sliding layer. Specifically, the filler particles are preferred to has a volume average particle size ranged from 5 to 15 μm (inclusive). In the embodiment(s), PTEF particles having 5 μm of the volume average particle size were used. It is preferred that the filler particles are contained in a weight of about 34 to 67% based on the weight of the binder resin. In the embodiment(s), the filler particles (PTFE) were contained at 50% of a weight (or weight ratio) with respect to the binder resin (PAI).

The opposing member 52 can further have another filler such as graphite added. By the opposing member 52 containing a filler such as graphite, slidability and thermal conductivity of the opposing member 52 further improve. In this example, for example, by spraying a PAI solvent containing PTFE onto a face of the heat diffusion member 51 and heating it, the resin hardens, forming the opposing member 52 on the heat diffusion member 51. The thickness Tb of the opposing member 52 is controlled by adjusting the number of spraying for example. In this example, the long direction (Y-axis direction) length of the opposing member 52 is about 264.9 mm, and the short direction (approximate Z-axis direction) length of the opposing member 52 is about 17.55 mm. That is, the opposing member 52 covers approximately the whole surface of the heat diffusion member 51 opposing the inner circumferential face 56S of the annular belt 53. The opposing face SF of the opposing member 52 opposes the annular belt 53 as mentioned above, and the inner circumferential face 56S of the circularly-rotating annular belt 53 slides on the opposing face SF. Therefore, in order to improve slidability of the inner circumferential face 56S with the opposing face SF, as shown in FIG. 11, the sliding grease GR as a lubricant should better be installed between the annular belt 53 and the opposing face SF of the opposing member 52. The sliding grease GR is applied to the opposing face SF for example. Therefore, the annular belt 53 slides on the opposing face SF through the sliding grease GR. The sliding grease GR is a gelatinous grease containing silicone-based materials and/or fluorine-based materials for example. Note that although in this example, the binder resin 52B of the opposing member 52 contains PAI, it is not limited to this but can contain another resin. Listed as the other resin is polyimide (PI) that can improve slidability of the annular belt 53 and is excellent in heat resistance and mechanical strength. Also, although the opposing member 52 contains the filler particles 52F of PTFE, it can contain another fluorine-based resin such as a copolymer of tetrafluoroethylene and perfluoroalkoxy ethylene (PFA) as the filler particles 52F. Alternatively, it can also contain the filler particles 52F made of another kind of material such as molybdenum disulfide. Furthermore, although a filler such as graphite is added to the opposing member 52, this invention is not limited to this, but no filler can be added. Also, although the opposing member 52 covers approximately the whole surface of the second face 51B of the heat diffusion member 51 opposing the inner circumferential face 56S of the annular belt 53, this invention is not limited to this, but instead, part of the second face 51B of the heat diffusion member 51 can be covered for example. Also, the thickness Tb of the opposing member 52 is not limited to the example thickness.

The annular belt 53 is an annular belt stretched with a prescribed tensile force by the stay 41 and is configured so as to be held rotatably. It has the inner circumferential face 56S opposing the opposing face SF and is configured so as to slide on the opposing face SF with this inner circumferential face 56S. The annular belt 53 forms the nip part N (FIG. 5) between it and the pressure application roller 60.

Figure 12:
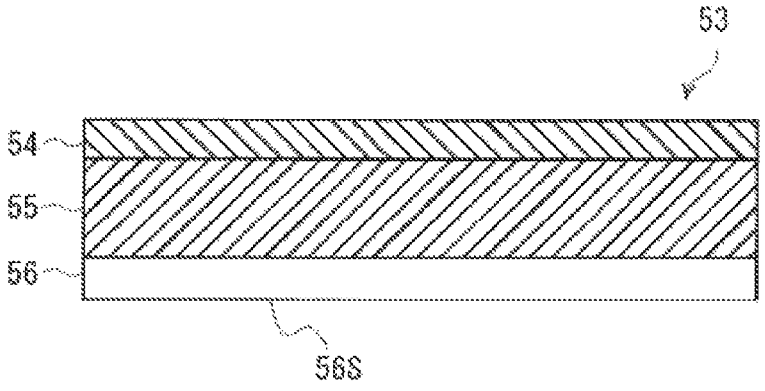
FIG. 12 is a schematic cross-sectional view for explaining the outline of an annular belt shown in FIG. 4.

FIG. 12 is a schematic cross-sectional view for explaining the outline of the annular belt 53. The annular belt 53 has a surface layer 54, an elastic layer 55, and a substrate layer 56. That is, the elastic layer 55 is formed on the substrate layer 56, and the surface layer 54 is formed on the elastic layer 55.

The surface layer 54 comprises a copolymer of tetrafluoroethylene and perfluoroalkylvinylether (PFA) in this example. The thickness of the surface layer 54 is 20 μm for example. The thickness of the surface layer 54 is desired to be a size that allows following the deformation of the elastic layer 55. On the other hand, if the thickness of the surface layer 54 is too small, wrinkles occur on the surface layer 54 due to sliding with the pressure application roller 60 or the recording medium PM, therefore the thickness of the surface layer 54 should preferably be 10~50 μm. Also, the surface layer 54 is desired to have heat resistance that allows withstanding fusing temperature and releasability that makes it hard for toner remaining on the annular belt 53 and paper dusts originating from the recording medium PM to stick onto it, and should preferably be made of a fluorine-substituted material. Note that the material of the surface layer 54 is not limited to the example material, and the thickness of the surface layer 54 is not limited to the example thickness.

The elastic layer 55 comprises a silicone rubber having heat resistance that can withstand the fusing temperature in this example. The rubber hardness of the elastic layer 55 is 12 degrees for example, and the thickness of the elastic layer 55 is 300 μm for example. The elastic layer 55 is desired to have rubber strength and thickness that allows forming the nip part N. On the other hand, the elastic layer 55 is desired to suppress loss of heat generated from the heater 44 and efficiently transmit heat generated from the heater 44 to the outer circumferential face (toner contact face) of the annular belt 53. If the thickness of the elastic layer 55 is large, although the uniform nip part N tends to be formed, the heat capacity increases, and the heat loss increases, which is not preferable. The thickness of the elastic layer 55 should preferably be 50~500 μm. Also, the rubber hardness of the elastic layer 55 should preferably be 10~60 degrees to enhance the uniformity of the nip part N. Note that although in this example the elastic layer 55 contains a silicone rubber, it is not limited to this but can contain another material having heat resistance that can withstand the fusing temperature. The elastic layer 55 can contain a fluororubber for example. Note that the thickness of the elastic layer 55 is not limited to the example thickness.

The substrate layer 56 comprises polyimide (PI), and the main ingredient of the substrate layer 56 is PI in this example. Here, the main ingredient means an ingredient occupying 50 weight % of the whole substrate layer 56. That is, the PI content is greater than those of any other materials in the substrate layer 56. The inner diameter of the substrate layer 56 is 30 mm for example, and the thickness of the substrate layer 56 is 80 μm for example. The substrate layer 56 allows the annular belt 53 to develop durability and mechanical strength, and is superior in mechanical strength, repeated bending resistance, and buckling resistance. That is, because the substrate layer 56 has a high Young's modulus and high buckling strength, the annular belt 53 is hard to rupture. Note that although in this example the substrate layer 56 contains PI, it is not limited to this but can contain another material having high heat resistance, a high Young's modulus, and high buckling strength. The substrate layer 56 can contain stainless steel or a polyetheretheretherketone (PEEK) material for example. Especially preferred is a resin material superior in heat resistance such as polytetrafluoroethylene (PTFE). Also, the substrate layer 56 can contain a material to which added is a conductive filler containing carbon black and metallic elements such as zinc, in which case the substrate layer 56 can develop conductivity. Also, the substrate layer 56 can contain PTFE to which added is a filler such as boron nitride, in which case slidability and thermal conductivity of the substrate layer 56 can be improved. Note that the thickness of the substrate layer 56 is not limited to the example thickness.

In the application, the heat generated with the heater 44 is conveyed to the annular belt 53 passing through the heat transmission member 50. When determining two contact surfaces that are first contact surface, which is formed between the heater and the heat transmission member, and second contact surface, which is formed between the heat transmission member and the annular belt, the second contact surface (or its area) is about 40 to 60% larger than the first contact surface (or its area). In the embodiment(s), the second contact surface was 50% larger than the first contact surface.

Assuming that an area (S1) of the first contact surface is 1, an area (S2) of the second contact surface becomes from 1.4 to 1.6, and a difference (ΔS) between S2 and S1 becomes from 0.4 to 0.6. As described above, the thickness (Tb) of the opposing member 52 is preferred from 0.005 mm to 0.015 mm (inclusive). Based on these numbers, the following relationship and table are obtained:

$$26.7\ (\mathrm{mm}^{-1}) \leq \Delta S/Tb \leq 120\ (\mathrm{mm}^{-1})$$

Supplemental Table

| | | Tb (mm) | |
|---|---|---|---|
| | | 0.005 | 0.015 |
| ΔS (S2 − S1) | 0.4 | 80 | 26.7 |
| | 0.6 | 120 | 40 |

(Pressure Application Roller 60)

Figure 13:
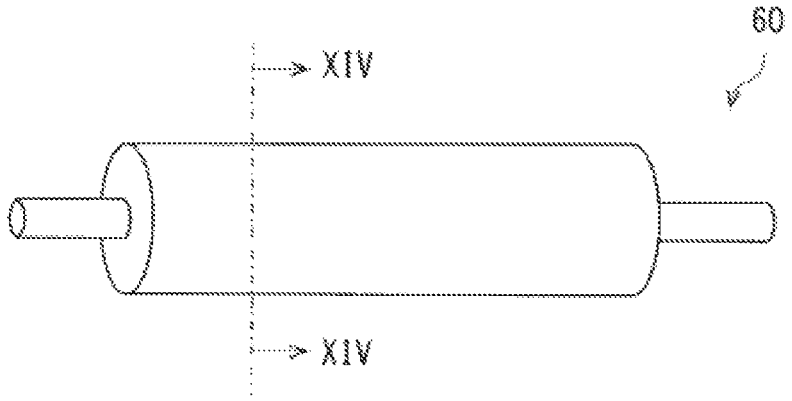
FIG. 13 is an explanatory diagram for explaining the outline of a pressure application roller shown in FIG. 2.
Figure 14:
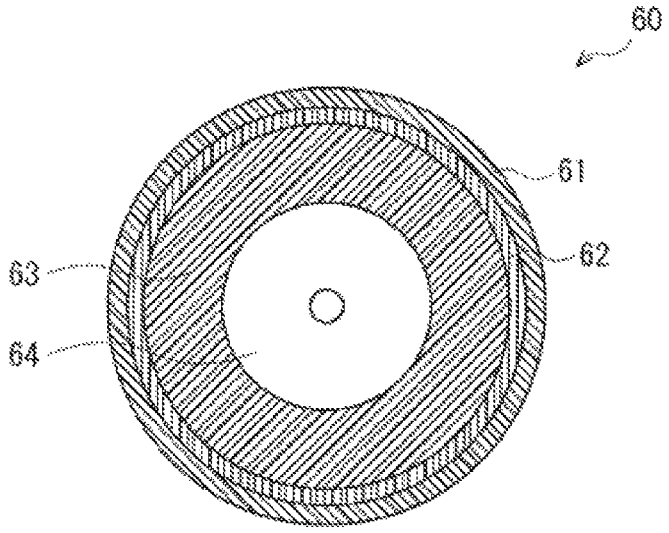
FIG. 14 is a schematic cross-sectional view for explaining the outline of the pressure application roller shown in FIG. 13.

FIG. 13 is an explanatory diagram for explaining the outline of the pressure application roller 60. FIG. 14 is a schematic cross-sectional view of the pressure application roller 60 viewed in an arrow direction along a line XIV-XIV shown in FIG. 13. The pressure application roller 60 is a rotation member that is installed allowing it to contact the outer circumferential face of the annular belt 53 in the annular belt unit 40 so that the nip part N is formed between it and the annular belt unit 40, and applies pressure onto an image on the recording medium PM. It is preferable that the outer diameter of the pressure application roller 60 is 40 mm and that the hardness of the pressure application roller 60 is 50~65 degrees. The pressure application roller 60 has a surface layer 61, an adhesion layer 62, an elastic layer 63, and a shaft 64. That is, the elastic layer 63 is formed on the shaft 64, the adhesion layer 62 is formed on the elastic layer 63, and the surface layer 61 is formed on the adhesion layer 62. Note that an adhesion layer can be installed between the shaft 64 and the elastic layer 63.

The surface layer 61 comprises PFA in this example. The thickness of the surface layer 61 is 30 μm for example. The surface layer 61 slides with the recording medium PM and the annular belt 53. Similarly, to the surface layer 54 of the annular belt 53, the thickness of the surface layer 61 is desired to be a size that allows following the deformation of the elastic layer 63. On the other hand, if the thickness of the surface layer 61 is too small, wrinkles occur on the surface layer 61 due to sliding with the annular belt 53 or the recording medium PM, therefore the thickness of the surface layer 61 should preferably be 15~50 μm. Also, the surface layer 61 is desired to have heat resistance that can withstand the fusing temperature and releasability that makes it hard for toner remaining on the annular belt 53 and paper dusts originating from the recording medium PM to stick onto it, therefore should preferably be made of a fluorine-substituted material. The material of the surface layer 61 is not limited to the example material, and the thickness of the surface layer 61 is not limited to the example thickness.

The adhesion layer 62 comprises a silicone adhesive that has a sufficient bonding power, to which a conductive material is added, and can withstand the fusing temperature in this example. The adhesion layer 62 bonds the elastic layer 63 and the surface layer 61 to prevent the surface layer 61 from peeling off the elastic layer 63 and suppress wrinkle occurrences. Because the adhesion layer 62 has conductivity, it suppresses accumulation of charge on the pressure application roller 60 in continuous printing that causes paper dusts etc. to adhere electrostatically. Note that although in this example the conductive material is added to the adhesion layer 62, this invention is not limited to this, but no conductive material needs to be added. Note that the material of the adhesion layer 62 is not limited to the example material.

The elastic layer 63 comprises a silicone sponge having foam cells to which a conductive material is added in this example. The thickness of the elastic layer 63 is 4 mm for example. Because the elastic layer 63 has conductivity, it suppresses accumulation of charge on the pressure application roller 60 in continuous printing that causes paper dusts etc. to adhere electrostatically. The elastic layer 63 is desired to have rubber hardness and thickness that allows forming the nip part N. Also, the elastic layer 63 is desired to have a heat accumulation capacity so as to prevent loss of heat transmitted from the annular belt 53 to the image and the recording medium PM. Also, in order to prevent a nip mark from remaining on the pressed nip part N, the cell diameters of the foam cells should preferably be small, and specifically the average cell diameter of the foam cells should preferably be 20~250 μm. In this example, the average cell diameter is 100 μm. Measurement of the average cell diameter was performed by cutting the silicone sponge using a razor etc., observing it with a CCD (Charge Coupled Device) microscope, measuring 10 cell diameters within the observation field of view, and taking their average. Note that although in this example the conductive material is added to the elastic layer 63, this invention is not limited to this, but no conductive material needs to be added to the elastic layer 63. Also, although the elastic layer 63 comprises the silicon sponge, it is not limited to this but can contain another material. The elastic layer 63 can contain a solid rubber for example. Note that the thickness of the elastic layer 63 is not limited to the example thickness.

The shaft 64 is a member having pressure resistance that makes it not deform by the fusing pressure, and comprises solid stainless steel (SUS304) for example. Note that although in this example the shaft 64 contains SUS304, it is not limited to this but can contain another material instead. Also, although in this example a solid shaft is used, this invention is not limited to this, but a hollow shaft can be used instead for example.

The fusing device 30 is further configured so as to satisfy the following Conditional Expression (1)

$$D/L \geq 0.18 \times S - 28 \quad (1)$$

Figure 15:
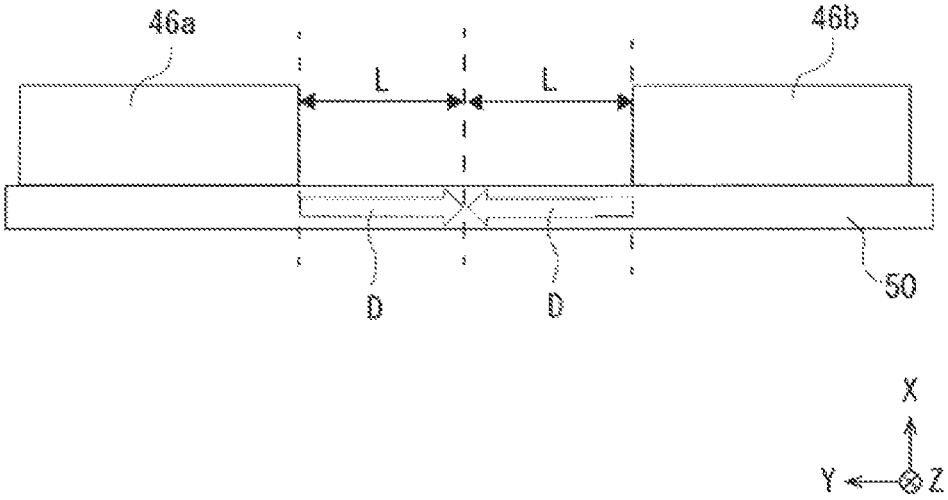
FIG. 15 is a schematic diagram for explaining Conditional Expression (1).

Note that as shown in FIG. 15, denoted as D is the in-plane thermal diffusivity [$\times 10^{-6}$ $m^2/s$] along the first face 51A of the heat transmission member 50, L is half the interval [$\times 10^{-3}$ m] of two adjacent heat generation parts 46 in the planar direction along the first face 51A, and S is the carrying speed [$\times 10^{-3}$ m/s] of the recording medium PM in the fusing device 30.

The in-plane thermal diffusivity D of the heat transmission member 50 is 6.2 [$\times 10^{-6}$ $m^2/s$] or higher and 60.4 [$\times 10^{-6}$ $m^2/s$] or lower for example. Also, the carrying speed S of the recording medium PM is 160 [$\times 10^{-3}$ m/s] or higher and 213 [$\times 10^{-3}$ m/s] or lower for example. Furthermore, the interval 2L of two heat generation parts 46 is 2.0 [$\times 10^{-3}$ m] or greater and 5.0 [$\times 10^{-3}$ m] or smaller for example. Note that the interval 2L here is the maximum distance in the space between the heat generation parts 46 along the Y-axis direction that is the long direction of the heater 44 for example (see FIG. 16 below).

In this embodiment, the annular belt 53 corresponds to a specific example of the "annular belt" in this invention. The heat transmission member 50 corresponds to a specific example of the "heat transmission member" in this invention, the heat diffusion member 51 corresponds to a specific example of the "heat diffusion member" in this invention, and the first face 51A corresponds to a specific example of the "first face" in this invention. The opposing member 52 corresponds to a specific example of the "opposing member" in this invention, and the opposing face SF corresponds to a specific example of the "second face" in this invention. The fusing device 30 corresponds to a specific example of the "fusing device" in this invention. The heater 44 corresponds to a specific example of the "heating member" in this invention.

Actions and Effects (A. Basic Operations)

In the image forming apparatus 1, an image is transferred to the recording medium PM in the following manner.

First, referring to FIG. 1, the whole operation of the image forming apparatus 1 is explained. Once the image forming apparatus 1 receives print data from the higher-level device, each development unit 11 rotates its photosensitive drum 12 to perform an image forming process.

In the image forming apparatus 1, each exposure unit 17 selectively radiates light onto the photosensitive drum 12 whose surface is charged in the development unit 11, thereby forming an electrostatic latent image on the surface of the photosensitive drum 12. Then, an image is formed according to the electrostatic latent image on the photosensitive drum 12.

When the image forming apparatus 1 transfers an image to the recording medium PM stacked on the sheet feeding tray 3, by power transmitted from a hopping motor (not shown) the hopping roller 4 feeds the recording medium PM toward the registration roller pair 5. The registration roller pair 5 carries the recording medium PM toward the image forming part 10. In doing so, by the front edge of the recording medium PM abutting against the registration roller pair 5, skew of the recording medium PM is corrected.

Afterwards, in the image forming part 10, the transfer belt 19 circularly rotates, thereby carrying the recording medium PM toward the fusing device 30. In doing so, the recording medium PM passes between the photosensitive drum 12 and the transfer roller 22.

In the image forming apparatus 1, once an image is formed on the surface of the photosensitive drum 12, the transfer belt unit 18 performs a transfer process. In doing so, in the transfer belt unit 18, while the transfer belt 19 carries the recording medium PM, the transfer roller 22 draws the image formed on the surface of the photosensitive drum 12.

As a result, the image is transferred from the photosensitive drum 12 to the recording medium PM.

Once the image is transferred from the photosensitive drum 12 to the recording medium PM, the image forming apparatus 1 carries the recording medium PM to the fusing device 30. Once the recording medium PM has been carried, the fusing device 30 performs a fusing process. In doing so, the fusing device 30 applies heat and pressure to the image transferred to the surface of the recording medium PM, melting and fusing the image to the recording medium PM.

One the image is fused to the recording medium PM, the image forming apparatus 1 carries the recording medium PM toward the stacker 9, and ejects the recording medium PM onto the stacker 9.

The whole operation of the image forming apparatus 1 is as mentioned above.

(B. Behavior of Heat Transmission Member 50 in Fusing Operation)

Next, explained is the behavior of the heat transmission member 50 in a fusing operation when the recording medium PM to which an image is transferred is carried from the image forming part 10 toward the fusing device 30.

When the fusing device 30 performs the fusing operation, the drive gears 35 transmit power from the annular belt motor to the pressure application roller 60. In doing so, the levers 33L and 33R are released from the lever fixing members according to the operation of the drive gears 35, thereby the levers 33L and 33R rotate in the D1 direction (FIG. 4) centering on the rotation fulcrums 34L and 34R. Therefore, the annular belt unit 40 is pressed against the pressure application roller 60, thereby the nip part N is formed between the annular belt unit 40 and the pressure application roller 60. In this example, the length of the nip part N in the long direction (Y-axis direction) is 227 mm, the length of the nip part N in the short direction (approximate Z-axis direction) intersecting perpendicularly with the long direction is 8~11 mm. Also, the load on the annular belt unit 40 over the whole nip part N is 33~39 kg such as 36 kg. The nip pressure for the 36 kg load is 1.32~2.15 kg/cm$^2$. The pressure application roller 60 rotates by the power transmitted from the annular belt motor. The annular belt 53 follows the pressure application roller 60 according to the rotation of the pressure application roller 60. Thereby, in the annular belt unit 40, the opposing face SF of the opposing member 52 of the heat transmission member 50 and the annular belt 53 slide with each other through the sliding grease. At this time, in the annular belt unit 40, the heat transmission member 50 is pressed against the heater 44. Also, in the fusing operation, the electric wires 45 let a current supplied from the external power source flow to each of the heat generation parts 46*a*~46*e*, thereby the heater 44 generates heat. Heat generated by the heater 44 is transmitted to the heat transmission member 50 through the heat conducting grease, and is transmitted to the annular belt 53 through the sliding grease. By the recording medium PM passing through the nip part N, heat is transmitted from the annular belt 53 and pressure is applied by the nip part N to the image transferred onto the recording medium PM, fusing the image onto the recording medium PM.

Figure 16:
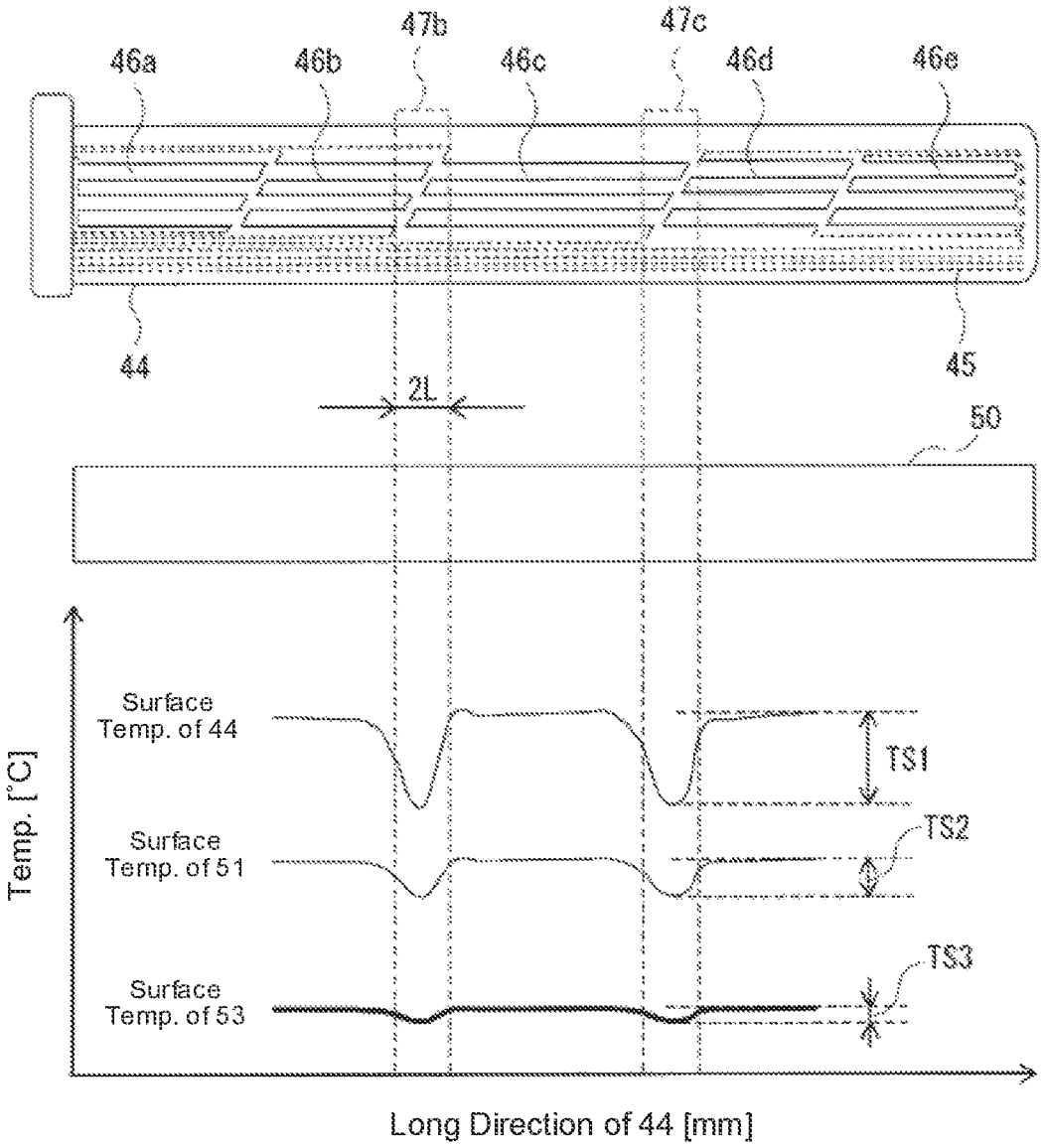
FIG. 16 is an explanatory diagram for explaining the actions of a heat diffusion member shown in FIG. 5.

FIG. 16 shows the relationship among the surface temperatures of the heater 44, the heat transmission member 50, and the annular belt 53. Indicated by the horizontal axis in FIG. 16 is the long direction (Y-axis direction) length of the heater 44, and the vertical axis is temperature. Shown in this example are the positional relationship between the heater 44 and the heat transmission member 50, and an example of measurement results of the surface temperatures of the heater 44, the heat transmission member 50, and the annular belt 53 over a range of the heat generation parts 46*b* through 46*d*. The surface temperature of the heater 44 becomes higher on the parts where the heat generation parts 46*b*, 46*c*, and 46*d* are installed. On the other hand, the surface temperature of the heater 44 becomes lower on the seams 47*b* and 47*c*, and a temperature difference TS1 occurs between the high temperature spots and the low temperature spots on the heater 44. Because heat is transmitted to the heat transmission member 50 according to the surface temperature distribution of the heater 44, a temperature difference occurs also on the heat transmission member 50 between high surface temperature spots and low surface temperature spots. Their temperature difference TS2 is smaller than the temperature difference TS1. That is, the heat transmission member 50 aims at reducing temperature variation over the long direction (Y-axis direction) of the heater 44. Because heat is transmitted to the annular belt 53 according to the surface temperature distribution of the heat transmission member 50, a temperature difference TS3 occurs also on the annular belt 53 between high surface temperature spots and low surface temperature spots. However, the temperature difference TS3 is even smaller than the temperature difference TS2 on the heat transmission member 50. The temperature difference TS3 should preferably be 2° C. or smaller. In this case, a difference in reflectivity between the high surface temperature spots and the low surface temperature spots on the annular belt 53 becomes 2.8 or lower for example, therefore their glossiness difference is hard to recognize visually. That is, if the temperature difference TS2 is 2° C. or smaller, even the low surface temperature spots on the annular belt 53 can achieve temperature that allows melting toners. Therefore, unevenness in glossiness of the image becomes hard to occur, obtaining a fine fusing performance.

(C. Effects)

In this manner, the fusing device 30 of this embodiment is provided with the annular belt 53, the heater 44 having the heat generation parts 46*a*~46*e*, and the heat transmission member 50, and is configured so as to satisfy Conditional Expression (1) regulating the relationship among the in-plane thermal diffusivity D and the length L of the heat transmission member 50 and the carrying speed S of the recording medium PM. Thereby, variation in surface temperature of the annular belt 53 can be reduced. Therefore, fusing unevenness is reduced, which allows forming an image fused uniformly over the whole recording medium PM. That is, by appropriately selecting the thermal diffusivity D and the length L, the carrying speed S can be increased while securing fine qualify of the image formed on the recording medium PM.

Also, because the heat transmission member 50 comprises a stacked structure where the opposing member 52 is installed between the heat diffusion member 51 and the annular belt 53, wear of the heat diffusion member 51 due to contacting the annular belt 53 can be avoided. Therefore, aluminum that is softer than stainless steel etc. can be used for the heat diffusion member 51. By adopting aluminum as the main ingredient of the heat diffusion member 51, higher thermal diffusivity D can be obtained than adopting stainless steel for example as the main ingredient of the heat diffusion member 51, therefore fusing unevenness is further reduced, and the fusing performance is further improved. Furthermore, by adopting aluminum as the main ingredient of the heat diffusion member 51, weight reduction can be achieved in comparison with adopting stainless steel as the main ingredient of the heat diffusion member 51.

Also, because in this embodiment a resin such as polyimide is adopted as the main ingredient of the annular belt 53, weight reduction is possible in comparison with adopting a metal as the main ingredient of the annular belt for example, and it is also advantageous for cost reduction. Furthermore, wear of the heat transmission member 50 can be reduced.

Also, in the fusing device 30 of this embodiment, because the opposing member 52 contains the binder resin 52B and the filler, a mechanical load to the annular belt 53 can be reduced in comparison with adopting an opposing member made by glass coating for example.

Also, in the fusing device 30 of this embodiment, because adopted is the opposing member 52 where the filler particles 52F are dispersed in the binder resin 52B, the recess-protrusion structure of an appropriate size is formed on the above-mentioned opposing face SF. As a result, the sliding grease GR can be held in the recess part of the opposing face SF, thereby slidability of the inner circumferential face 56S with the opposing face SF can be improved. Especially, by forming the filler particles 52F of a fluorine-based resin, higher heat resistance can be secured.

Also, in the fusing device 30 of this embodiment, if the average particle diameter of the filler particles 52F is set to 1 μm or greater and 30 μm or smaller, it is preferable for realizing an appropriate arithmetic mean roughness Ra of the opposing face SF while securing a preferable heat transmitting performance to the annular belt 53.

Also, in the fusing device 30 of this embodiment, because the dynamic friction coefficient of the filler particles 52F is set smaller than the dynamic friction coefficient of the binder resin 52B, slidability of the inner circumferential face 56S with the opposing face SF can be further improved.

Also, in the fusing device 30 of this embodiment, because the filler particles 52F contain PTFE, due to self-lubricity of the filler particles 52F, slidability of the inner circumferential face 56S of the annular belt 53 with the opposing face SF of the opposing member 52 is believed to improve further.

Also, in the fusing device 30 of this embodiment, the heater 44 includes the multiple heat generation parts 46*a*~46*e* arranged along the width direction (Y-axis direction) intersecting perpendicularly with the rotation direction of the annular belt 53. Thereby, the heat generation part 46*a*~46*e* can be selectively electrified so as to generate heat according to the width of the recording medium PM. By the way, the seams 47*a*~47*d* occur among the multiple heat generation parts 46*a*~46*e*. Because the seams 47*a*~47*d* tend to become lower in temperature than other parts, the grease tend to have lower viscosity. As a result, unevenness in thickness of the sliding grease GR can easily occur. However, in this embodiment, by satisfying Conditional Expression (1), such unevenness in temperature distribution caused by the seams 47*a*~47*d* can be reduced, and as a result, unevenness in thickness of the sliding grease GR can be sufficiently reduced. Therefore, fusing unevenness can be reduced, thereby an image fused uniformly over the whole recording medium PM can be formed.

2. EXPERIMENTAL EXAMPLES

Experimental Example 1

Prepared was a heat transmission member 50 where no opposing member 52 is installed on a heat diffusion member 51 having aluminum (AL5052) as its main ingredient, a fusing device 30 provided with the heat transmission member 50 was mounted in an image forming apparatus (color printer C833 manufactured by Oki Data Corporation), and its fusing performance was evaluated. Evaluations on the fusing performance were performed by setting the fusing speed, that is the carrying speed S of a recording medium PM in the fusing device 30 to 5 levels within a range of 160 mm/s or higher and 231 mm/s or lower, fusing processes were performed at those 5 levels, and checking two points of the presence/absence of spontaneous peeling and unevenness in glossiness of a toner image after each fusing process. The spontaneous peeling of the toner image after the fusing process means that the toner image is separated away from the recording medium PM.

In this experiment, the heat transmission member 50 is configured with either one of or a combination of members (or materials) following: an aluminum substrate (a), a fluorine resin film (b), a resin tape (c), SUS substrate (d), glass (e) (or glass plate). The following Experimental Examples 1 to 6 are described with Exam. 1 to Exam. 6 in Table 1.

In this experimental example, in the image forming part 10, after forming a duty 200% blue toner image obtained by sequentially forming a duty 100% magenta toner pattern and a duty 100% cyan toner pattern on the recording medium PM, the fusing process of the toner image is performed in the fusing device 30. The magenta toner deposition amount is 0.45 mg/cm$^2$ and the cyan toner deposition amount is 0.40 mg/cm$^2$ in this blue toner image. Also, glass transition temperature $T_{gM}$ of the magenta toner used in this experimental example is 56±4° C., and glass transition temperature $T_{gC}$ of the cyan toner is 56±3° C. Here, duty 100% means, for example, that the printed region occupies 100% in area of a prescribed printable region such as one round of a photosensitive drum or one page of a print medium. Duty 1% means, for example, that the printed region occupies 1% in area of the printable region. That is, the area occupied by an image formed with duty 1% corresponds to 1% of the area occupied by an image formed with duty 100%. Duty is expressed by Equation (2).

$$\text{Duty}=[Cm(i)/(Cd\times C0)]\times 100 \quad (2)$$

Note that Cm(i) is the number of used dots for printing when the photosensitive drum 12 has made Cd rotations. That is, Cm(i) is the number of exposed dots. Also, C0 is the maximum number of usable dots in printing when the photosensitive drum 12 makes one rotation. That is, regardless of the presence/absence of exposure, C0 is the number of potentially-usable dots when the photosensitive drum 12 makes one rotation. Cd×C0 is the maximum number of usable dots in printing when the photosensitive drum 12 makes Cd rotations.

The presence/absence of peeling and/or unevenness in glossiness of the toner image after the fusing process was visually checked. The results are listed in Table 1. In Table 1, evaluations on the fusing performance are indicated in 3 levels of A, B, and F. The evaluation A means that there was no spontaneous peeling or unevenness in glossiness of the toner image after the fusing process. The evaluation B means that although there was no spontaneous peeling of the toner image after the fusing process, slight unevenness in glossiness was observed. The evaluation F means there were both spontaneous peeling and unevenness in glossiness of the toner image after the fusing process. Here, although the evaluations A and B are tolerable levels, the evaluation F is an intolerable level. Also, adopted as the surface layer 54, the elastic layer 55, and the substrate layer 56 of the annular belt 53 were those made of PFA (thickness 20 μm), a silicone rubber of 20 degrees in rubber hardness (thickness 300 μm), and a sleeve of SUS304 (outer diameter 30 mm and thickness 30 μm). Note that the reason for using a sleeve made of a metal as the substrate layer 56 is that compared with using a sleeve made of a resin as the substrate layer 56 for example, temperature distribution due to a difference in intervals of the heat generation parts 46*a*~46*e* becomes easier to appear, and its effect becomes easier to check. Furthermore, adopted as the surface layer 61, the adhesion layer 62, the elastic layer 63, and the shaft 64 of the pressure application roller 60 were those made of PFA (thickness 30 μm), a silicone adhesive, a silicone sponge (thickness 3 mm) having foam cells of 100 μm in cell diameter, and a hollow stainless steel (SUS304).

TABLE 1

| Configuration of HTM | Thermal Diffusivity D [mm²/s] | D/L [mm/s] | Fusing Performance 160 mm/s | 171 mm/s | 180 mm/s | 210 mm/s | 231 mm/s |
|---|---|---|---|---|---|---|---|
| Exam. 1 (a) | 60.4 | 24.2 | A | A | A | A | A |
| Exam. 2 (a)/(b) | 54.6 | 21.8 | A | A | A | A | B |
| Exam. 3 (c)/(a)/(b) | 36.8 | 14.7 | A | A | A | B | B |
| Exam. 4 (d) | 6.6 | 2.6 | A | F | F | F | F |
| Exam. 5 (d)/(b) | 6.4 | 2.6 | A | F | F | F | F |
| Exam. 6 (d)/(e) | 6.2 | 2.5 | A | F | F | F | F |

<<EVALUATION MARKS>>
A: No Peeling of Toner Image No Unevenness in Glossiness
B: No Peeling of Toner Image but Unevenness in Glossiness Observed
F: Peeling of Toner Image and Unevenness in Glossiness Observed Note that the thickness of the heat diffusion member 51 was set to 0.485 mm. For measuring the thickness of the heat diffusion member 51, a micrometer MDC-25MJ (manufactured by Mitutoyo Corporation) was used. Also, the planar size of each sample was set to 15×40 mm, and the length L 2.5 mm.

Figure 17:
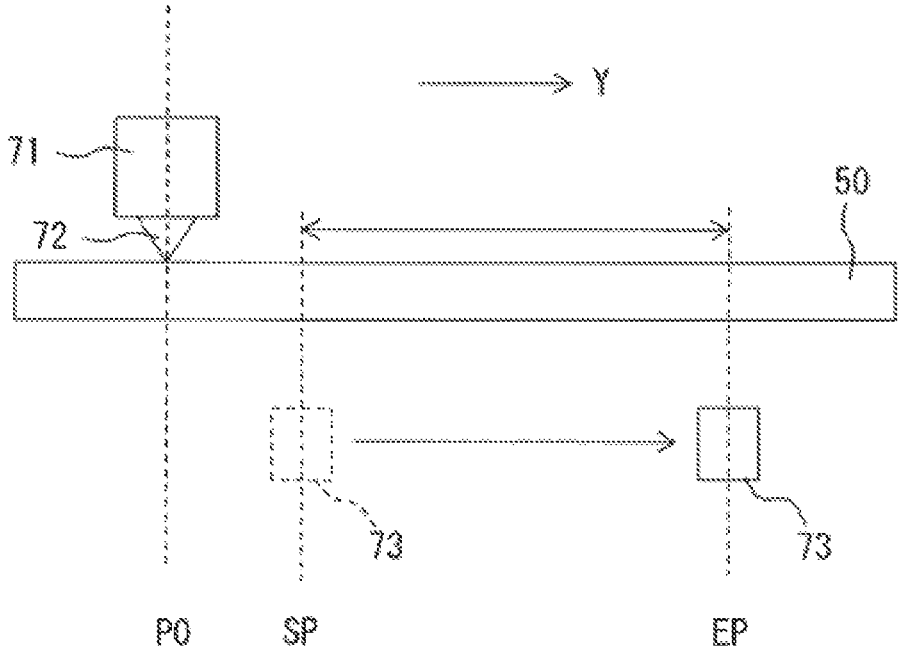
FIG. 17 is an explanatory diagram for explaining the measurement method of the in-plane thermal diffusivity of the heat transmission member.

Also, as shown in FIG. 17, the in-plane thermal diffusivity D [mm²/s] of the heat transmission member 50 was measured in the following conditions using the following measurement device. The results are also listed in Table 1. Note that the numerical values of the thermal diffusivity D listed in Table 1 are averages of values measured on 3 spots for each sample. Also, listed in Table 1 are values of the ratio D/L [mm/s] of the in-plane thermal diffusivity D to the length L of the heat transmission member 50. The ratio D/L [mm/s] is an index expressing easiness of heat transmission to the intermediate position of two adjacent heat generation parts.

Measurement device: "Thermowave Analyzer TA35" manufactured by Bethel Co., Ltd. Hudson Laboratory Measurement mode: Distance variation method Detector: InSb Surface treatment: Blackening treatment by spraying graphite onto the sample surface (the emission and detector sides)

Heating light: Semiconductor laser (wavelength 808 nm)

Pulse width: 10~100 μs

Beam angle: 48 degrees (condensed so as to form a spot diameter of 100~150 μm on the sample surface)

Sample size: 15×40×0.485 mm

Note that FIG. 17 is a schematic diagram explaining the measurement method of in-plane thermal diffusivity. Laser light 72 was radiated from a light source 71A onto a prescribed position P0 (fixed) on the first face 51A opposing the heater 44 in the heat transmission member 50, and temperature of the second face 51B opposing the annular belt 53 was measured by a temperature detector 73. Adopted for the temperature detector 73 was InSb that is a semiconductor element. The temperature detector 73 was let scan along the Y-axis direction from a starting position SP to an ending position EP, and infrared ray from the second face 51B was detected at specified intervals within a frequency range of 3.6~14.0 Hz (see, Freq. in Table 2). Listed in Table 2 are values of the measurement starting position [mm] (see Starting Position), the measurement ending position [mm] (see Ending Position), and the measurement interval [mm] (see Interval) regarding the position P0 as a reference position (0 [mm]) at every measured frequency. The measured ranges (see Range) are determined by the difference between the Ending Position and the Starting Position, and the values are shown at a column, "Measured [mm]" in Table 2.

TABLE 2

(Example 1: Aluminum (a) Only)

| Freq. [Hz] | Starting Position [mm] | Ending Position [mm] | Range [mm] | Interval [mm] |
|---|---|---|---|---|
| 3.6 | 0.8 | 3.8 | 3.0 | 0.30 |
| 5.0 | 0.8 | 3.2 | 2.4 | 0.24 |
| 7.2 | 0.8 | 2.7 | 1.9 | 0.19 |
| 11.0 | 0.8 | 2.2 | 1.4 | 0.14 |
| 14.0 | 0.8 | 1.9 | 1.1 | 0.11 |

Experimental Example 2

By spraying a PAI solvent containing PTFE onto a heat diffusion member 51 of 0.485 mm in thickness having aluminum (AL5052) as its main ingredient, which was heated afterwards, an opposing member 52 of 15 μm in thickness made of a fluorine resin was formed. Except for this point, in the same manner as in Experimental Example 1, a heat transmission member 50 as Experimental Example 2 was prepared, and using an image forming apparatus (color printer C833 manufactured by Oki Data Corporation) where a fusing device 30 provided with the heat transmission member 50 was mounted, the same fusing performance evaluations as in Experimental Example 1 were performed. Also, listed in Table 3 are values of the measurement starting position [mm], the measurement ending position [mm], and the measurement interval [mm] regarding the position P0 as a reference position (0 [mm]) at every frequency measured in Experimental Example 2.

TABLE 3

(Example 2: Al (a)/Fluorine Resin Film (b))

| Freq. [Hz] | Starting Position [mm] | Ending Position [mm] | Range [mm] | Interval [mm] |
|---|---|---|---|---|
| 2.0 | 0.8 | 4.4 | 3.6 | 0.36 |
| 2.9 | 0.8 | 3.8 | 3.0 | 0.30 |
| 4.1 | 0.8 | 3.2 | 2.4 | 0.24 |
| 5.9 | 0.8 | 2.7 | 1.9 | 0.19 |
| 8.8 | 0.8 | 2.2 | 1.4 | 0.14 |
| 12.0 | 0.8 | 1.9 | 1.1 | 0.11 |

Experimental Example 3

By spraying a PAI solvent containing PTFE onto a heat diffusion member 51 of 0.485 mm in thickness having aluminum (AL5052) as its main ingredient, which was heated afterwards, an opposing member 52 of 15 μm in thickness made of a fluorine resin was formed, and further a heat-resistant and insulating polyimide adhesive tape (Kapton (a trademark of DuPont-Toray Co., Ltd.) No. 360UL) having a thickness of 5 μm was pasted on the first face 51A. Except for this point, in the same manner as in Experimental Example 1, a heat transmission member 50 as Experimental Example 3 was prepared, and using an image forming apparatus (color printer C833 manufactured by Oki Data Corporation) where a fusing device 30 provided with the heat transmission member 50 was mounted, the same fusing performance evaluations as in Experimental Example 1 were performed.

Also, listed in Table 4 are values of the measurement starting position [mm], the measurement ending position [mm], and the measurement interval [mm] regarding the position P0 as a reference position (0 [mm]) at every frequency measured in Experimental Example 3.

TABLE 4

(Example 3: Resin Tape (c)/Al (a)/Fluorine Resin Film (b))

| Freq. [Hz] | Starting Position [mm] | Ending Position [mm] | Range [mm] | Interval [mm] |
|---|---|---|---|---|
| 0.8 | 0.8 | 1.7 | 0.9 | 0.09 |
| 1.0 | 0.8 | 2.0 | 1.2 | 0.12 |
| 2.1 | 0.8 | 2.4 | 1.6 | 0.16 |
| 3.0 | 0.8 | 2.9 | 2.1 | 0.21 |
| 4.2 | 0.8 | 3.4 | 2.6 | 0.26 |
| 6.5 | 0.8 | 3.8 | 3.0 | 0.30 |
| 8.5 | 0.8 | 3.8 | 3.0 | 0.30 |

Experimental Example 4

Prepared as Experimental Example 4 was a heat transmission member 50 where no opposing member 52 was installed in a heat diffusion member 51 of 0.550 mm in thickness having stainless steel (SUS430) as its main ingredient. Furthermore, using an image forming apparatus (color printer C833 manufactured by Oki Data Corporation) where a fusing device 30 provided with the heat transmission member 50 was mounted, the same fusing performance evaluations as in Experimental Example 1 were performed. Also, listed in Table 5 are values of the measurement starting position [mm], the measurement ending position [mm], and the measurement interval [mm] regarding the position P0 as a reference position (0 [mm]) at every frequency measured in Experimental Example 4.

TABLE 5

(Example 4: SUS (d) Only)

| Freq. [Hz] | Starting Position [mm] | Ending Position [mm] | Range [mm] | Interval [mm] |
|---|---|---|---|---|
| 0.4 | 0.9 | 3.3 | 2.4 | 0.24 |
| 0.6 | 0.9 | 2.8 | 1.9 | 0.19 |
| 0.8 | 0.9 | 2.3 | 1.4 | 0.14 |
| 1.2 | 0.9 | 1.9 | 1.0 | 0.10 |
| 1.6 | 0.9 | 1.7 | 1.8 | 0.08 |

Experimental Example 5

By splaying a PAI solvent containing PTFE onto a heat diffusion member 51 of 0.550 mm in thickness having stainless steel (SUS430) as its main ingredient, which was heated afterwards, an opposing member 52 of 15 μm in thickness made of a fluorine resin was formed. Except for this point, in the same manner as in Experimental Example 1, a heat transmission member 50 as Experimental Example 5 was prepared, and using an image forming apparatus (color printer C833 manufactured by Oki Data Corporation) where a fusing device 30 provided with the heat transmission member 50 was mounted, the same fusing performance evaluations as in Experimental Example 1 were performed. Also, listed in Table 6 are values of the measurement starting position [mm], the measurement ending position [mm], and the measurement interval [mm] regarding the position P0 as a reference position (0 [mm]) at every frequency measured in Experimental Example 5.

TABLE 6

(Example 5: SUS (d)/Fluorine Resin Film (b))

| Freq. [Hz] | Starting Position [mm] | Ending Position [mm] | Range [mm] | Interval [mm] |
|---|---|---|---|---|
| 0.25 | 1.0 | 4.0 | 3.0 | 0.30 |
| 0.33 | 1.0 | 3.3 | 2.3 | 0.23 |
| 0.46 | 1.0 | 2.8 | 1.8 | 0.18 |
| 0.67 | 1.0 | 2.3 | 1.3 | 0.13 |
| 1.00 | 1.0 | 1.9 | 0.9 | 0.09 |
| 1.30 | 1.0 | 1.7 | 0.7 | 0.07 |
| 2.00 | 1.0 | 1.5 | 0.5 | 0.05 |

Experimental Example 6

An opposing member 52 of 60 μm in thickness made of glass was formed by screen-printing on a heat diffusion member 51 of 0.550 mm in thickness having stainless steel (SUS430) as its main ingredient. Except for this point, in the same manner as in Experimental Example 1, a heat transmission member 50 as Experimental Example 6 was prepared, and using an image forming apparatus (color printer C833 manufactured by Oki Data Corporation) where a fusing device 30 provided with the heat transmission member 50 was mounted, the same fusing performance evaluations as in Experimental Example 1 were performed. Also, listed in Table 7 are values of the measurement starting position [mm], the measurement ending position [mm], and the measurement interval [mm] regarding the position P0 as a reference position (0 [mm]) at every frequency measured in Experimental Example 6.

TABLE 7

(Example 6: SUS (d)/Glass (e))

| Freq. [Hz] | Starting Position [mm] | Ending Position [mm] | Range [mm] | Interval [mm] |
|---|---|---|---|---|
| 0.34 | 1.0 | 3.3 | 2.3 | 0.23 |
| 0.48 | 1.0 | 2.8 | 1.8 | 0.18 |
| 0.69 | 1.0 | 2.3 | 1.3 | 0.13 |
| 1.00 | 1.0 | 1.9 | 0.9 | 0.09 |
| 1.40 | 1.0 | 1.6 | 0.6 | 0.06 |

Figure 18:
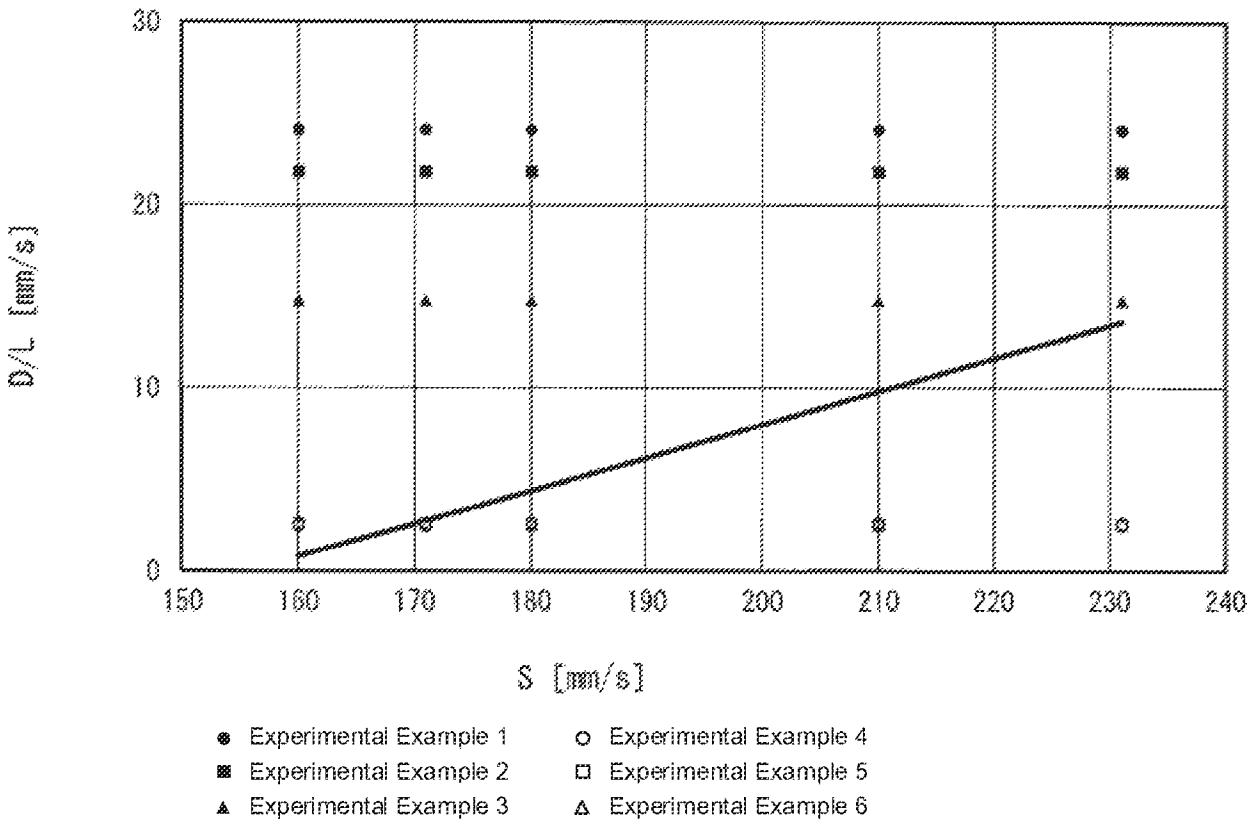
FIG. 18 is a characteristic diagram showing the characteristics of the fusing device in experimental examples.

The fusing performance evaluations for Experimental Examples 2~6 are also collectively listed in Table 1. Furthermore, shown in FIG. 18 is a plot of the relationship between the carrying speed S of the recording medium PM and the D/L value. In FIG. 18, the horizontal axis represents the carrying speed S [mm/s], and the vertical axis the ratio D/L [mm/s] of the in-plane thermal diffusivity D of the heat transmission member 50 to the length L. A straight line in FIG. 18 represents D/L=0.18×S−28.

As shown in Table 1 and FIG. 18, if D/L≥0.18×S−28 is satisfied, a fusing performance of the evaluation A or B was obtained.

Especially, in Experimental Examples 1-3 where the heat diffusion member 51 having aluminum (AL5052) as its main ingredient was used, a fusing performance of the evaluation A or B was obtained over the entire range of the carrying speed S of 160 mm/s or higher and 231 mm/s or lower. Because the ratio D/L [mm/s] in Experimental Examples 1-3 show higher values than in Experimental Examples 4~6, the reason is believed to be that the annular belt 53 is more uniformly heated efficiently in relatively a short time.

3. MODIFICATION EXAMPLES

Although this invention was explained above referring to embodiments, this invention is not limited to the above-mentioned embodiments, but various modifications are possible. For example, although explained in the above-mentioned embodiments was an image forming apparatus that can form a color image using toners in four colors, this invention is not limited to this, but an image forming apparatus that forms a color image in five or more colors.

Also, although this invention was explained in the above-mentioned embodiments showing a direct-transfer image forming apparatus as an example, it is also applicable to a secondary-transfer image forming apparatus provided with an intermediate transfer belt.

Furthermore, although explained in the above-mentioned embodiments was a printer having a print function as a specific example of the "image forming apparatus" in this invention, it is not limited to this. That is, this invention is also applicable to an image forming apparatus that functions as a multifunction peripheral having a scan function and/or a facsimile function for example in addition to such print function.

In the invention, the heat transmission member is as a whole in a plate shape having two surfaces (or the first and second faces). These faces are arranged to extend in the same direction as the width of the annular belt. Preferably, it is thinner than the annular belt. The first and second faces may be flat, or may be slightly curved to fit the annular belt or to fit the heat generation member (or an attachment of the heat generation member). The first face may have one or more recesses to accommodate the head generation parts thereinside.

What is claimed is:

1. A fusing device, comprising:

an annular belt that opposes a medium carried at a prescribed carrying speed, a heat generation member that has multiple heat generation parts installed apart from one another, the heat generation member being arranged inside the annular belt, and a heat transmission member that has two surfaces, which are first and second faces, and is installed between the heat generation member and the annular belt, wherein the first face opposes the heat generation member and the second face opposes the annular belt, and the heat transmission member transmits heat that is generated in the heat generation member to the annular belt, wherein the heat transmission member satisfies the following Conditional Expression (1):

$$D/L \geq 0.18 \times S - 28 \quad (1)$$

where

D means a thermal diffusivity [$\times 10^{-6}$ $m^2/s$] that is determined along the first face of the heat transmission member, L means a half of an interval [$\times 10^{-3}$ m] between two of the heat generation parts adjacent to one another, and S: the carrying speed [$\times 10^{-3}$ m/s] at which the medium is carried.

2. The fusing device according to claim 1, wherein the heat transmission member comprises a stacked structure in which a heat diffusion member and an opposing member are stacked, wherein the heat diffusion member has the first face and contains 50% or more of aluminum by weight, and the opposing member has the second face.

3. The fusing device according to claim 2, wherein the opposing member contains a binder resin and a filler, and a weight of the filler is ranged from 34 to 67% with respect to a weight of the binder resin.

4. The fusing device according to claim 3, wherein a dynamic friction coefficient of the filler is smaller than a dynamic friction coefficient of the binder resin.

5. The fusing device according to claim 1, wherein the annular belt contains 50% or more of a resin by weight.

6. The fusing device according to claim 1, wherein the thermal diffusivity of the heat transmission member is 6.2 [$\times 10^{-6}$ $m^2/s$] or higher and 60.4 [$\times 10^{-6}$ $m^2/s$] or lower.

7. The fusing device according to claim 1, wherein the carrying speed of the medium is 160 [$\times 10^{-3}$ m/s] or higher and 231 [$\times 10^{-3}$ m/s] or lower.

8. The fusing device according to claim 1, wherein the interval between the two of the heat generation members is 2.0 [$\times 10^{-3}$ m] or greater and 5.0 [$\times 10^{-3}$ m] or smaller.

9. The fusing device according to claim 1, wherein all the intervals between the two of the heat generation members are 2.0 [$\times 10^{-3}$ m] or greater and 5.0 [$\times 10^{-3}$ m] or smaller.

10. The fusing device according to claim 1, further comprising:

a pressure application member that is arranged to face the annular belt, wherein the pressure application member is pressed toward the annular belt to nip the medium, and the pressure application member carries the medium in collaboration with the annular belt.

11. The fusing device according to claim 1, wherein the two of the heat generation parts adjacent one another are arranged along the width direction of the annular belt, wherein the width direction intersects perpendicularly with a rotation direction of the annular belt along which the annular belt rotates.

12. An image forming apparatus, comprising the fusing device according to claim 1.

* * * * *